US011504678B2

(12) United States Patent
Doane et al.

(10) Patent No.: US 11,504,678 B2
(45) Date of Patent: Nov. 22, 2022

(54) SELF-CONTAINED FIRE PROTECTION SYSTEM

(71) Applicants: Bradley Philip Doane, Costa Mesa, CA (US); Christopher Phil Weill, Santa Barbara, CA (US)

(72) Inventors: Bradley Philip Doane, Costa Mesa, CA (US); Christopher Phil Weill, Santa Barbara, CA (US)

( * ) Notice: Subject to any disclaimer, the term of this patent is extended or adjusted under 35 U.S.C. 154(b) by 535 days.

(21) Appl. No.: 16/566,126

(22) Filed: Sep. 10, 2019

(65) Prior Publication Data

US 2021/0069659 A1 Mar. 11, 2021

(51) Int. Cl.
*B01F 23/00* (2022.01)
*B01F 23/45* (2022.01)
(Continued)

(52) U.S. Cl.
CPC ..... *B01F 23/45* (2022.01); *A62C 5/002* (2013.01); *A62C 27/00* (2013.01); *B01F 23/49* (2022.01); *B01F 25/50* (2022.01); *B01F 33/5021* (2022.01); *B01F 33/5026* (2022.01); *B01F 33/5027* (2022.01); *B01F 35/2205* (2022.01);
(Continued)

(58) Field of Classification Search
CPC .... B01F 23/483; B01F 25/50; B01F 35/2209; B01F 23/49; B01F 33/5021; B01F 33/5026; B01F 33/5027; B01F 35/2205; A62C 5/002; A62C 27/00; B05D 1/02
See application file for complete search history.

(56) References Cited

U.S. PATENT DOCUMENTS 5,582,776 A * 12/1996 Crawley ..... B01F 23/291 261/DIG. 26
6,267,183 B1 7/2001 Smagac
(Continued)

FOREIGN PATENT DOCUMENTS

WO 1994023798 A1 10/1994

OTHER PUBLICATIONS

"Interagency Retardant Base Planning Guide" United States Department of Agriculture Forest Service Technology & Development Program, 5100—Fire Management, Feb. 2006, 0651 1803-SDTDC.

*Primary Examiner* — Anshu Bhatia
(74) *Attorney, Agent, or Firm* — Lyon & Harr, LLP; Richard T. Lyon

(57) ABSTRACT

A "FirePOD" provides a self-contained, portable, standalone fire protection system that enables property owners, firefighters or others to mix and apply fire-protective gel or foam to entities such as structures, vehicles, vegetation, etc., to protect those entities from wildfire events or other external fire incidents. In various implementations, the FirePOD includes a recirculation-based mixing system for combining a mixture comprising a powder, liquid, or gel-based Thermal Protective Substance (TPS) with a volume of water or other liquid to produce the fire-protective gel or foam. By applying reconfigurable valves, one or more pumps are applied to both recirculate the mixture and, when sufficiently mixed, apply the resulting fire-protective gel or foam via one or more hoses or other dispensing mechanisms. In various implementations, the FirePOD is movable, and is manually or automatically propelled to locations suitable for applying the fire-protective gel or foam.

20 Claims, 8 Drawing Sheets

*Exemplary Implementation of a "Recirculation Mixer"*

(51) Int. Cl.

| | |
|---|---|
| ***A62C 27/00*** | (2006.01) |
| ***A62C 5/00*** | (2006.01) |
| ***B01F 23/40*** | (2022.01) |
| ***B01F 25/50*** | (2022.01) |
| ***B01F 33/502*** | (2022.01) |
| ***B01F 35/22*** | (2022.01) |
| *B05D 1/02* | (2006.01) |

(52) U.S. Cl.
CPC ..... *B01F 35/2209* (2022.01); *B01F 23/483* (2022.01); *B05D 1/02* (2013.01)

(56) References Cited

U.S. PATENT DOCUMENTS

| | | | | |
|---|---|---|---|---|
| 6,316,053 | B1 * | 11/2001 | Ragsdale ..... | B01F 35/712 427/244 |
| 7,104,334 | B2 | 9/2006 | Thompson | |
| 7,207,501 | B2 | 4/2007 | Hanratty | |
| 8,286,719 | B2 | 10/2012 | Vetesnik | |
| 9,764,174 | B2 | 9/2017 | Howard, Sr. | |
| 2006/0124321 | A1 | 6/2006 | Aamodt et al. | |
| 2009/0101366 | A1 | 4/2009 | Denardo | |
| 2013/0284462 | A1 | 10/2013 | Cordani | |
| 2015/0231430 | A1 * | 8/2015 | Cook ..... | A62C 25/00 169/24 |
| 2016/0051850 | A1 | 2/2016 | Menard | |
| 2018/0339180 | A1 | 11/2018 | Weber | |
| 2019/0168033 | A1 | 6/2019 | Conboy | |

* cited by examiner

*Exemplary Implementation of a "Recirculation Mixer"*

*Exemplary Tracked Vehicle FirePOD Implementation*

*Exemplary Wheeled Vehicle FirePOD Implementation*

*Exemplary Skid Base for FirePOD Implementation*

*Exemplary System for Implementing Automated FirePOD Functionality*

SELF-CONTAINED FIRE PROTECTION SYSTEM

BACKGROUND

The National Interagency Fire Center (NIFC) maintains statistics on wildfires in the United States. For example, the NIFC reports that there have been approximately 30,531 wildfires with over 3.7 million acres burned from Jan. 1, 2019 through Aug. 18, 2019. Similarly, for calendar year 2018, the NIFC reported a total of 58,083 wildfires with approximately 8.8 million acres burned. While such wildfires differ in size, it is significant that between 1997 and 2018, the NIFC reported approximately 200 wildfires each covering at least 100,000 acres.

Wildfires and other types of fires are typically engaged by one or more local fire departments using water trucks, fire hydrants, etc. Further, depending upon factors such as fire size, growth, danger to life or property, etc., firefighting efforts for wildfires or other types of fires may include air drops of water or fire retardant from helicopters or airplanes. Unfortunately, even with the rapid deployment of local, state, and federal firefighting resources, significant loss of life and property often occurs. For example, despite the deployment of firefighting resources from across the United States, a single well-known wildfire named the "Camp Fire," which began Nov. 8, 2018 in Butte County, Calif., was responsible for the loss of at least 88 human lives as well as the destruction of almost 14,000 residences and approximately 530 commercial structures. The Insurance Information Institute estimates that insured losses from the Camp Fire will total between $8.5 billion and $10.5 billion. Clearly, while such wildfires are eventually controlled, losses to life and property cannot be fully prevented by governmental firefighting resources.

As such, personal or portable firefighting equipment is sometimes deployed by homeowners or others in an attempt to protect individual structures (e.g., homes, offices, commercial buildings, etc.) from fires external to those structures. Examples of personal or portable firefighting equipment includes, but are not limited to, water or retardant-based fixed sprinkler systems designed to saturate the exterior of a building, chemical-based fire suppression units based on pumping systems powered by gasoline engines, electricity, or stored pressure, manual or automatic retardant-based systems designed to coat structures with a gel- or foam-based fire retardant, etc.

SUMMARY

The following Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Further, while certain disadvantages of other technologies may be discussed herein, the claimed subject matter is not intended to be limited to implementations that may solve or address any or all of the disadvantages of those other technologies. The sole purpose of this Summary is to present some concepts of the claimed subject matter in a simplified form as a prelude to the more detailed description that is presented below.

In general, a "Fire Protection On Demand" system or device, also referred to herein as a "FirePOD," provides a self-contained, portable, standalone fire protection system that enables property owners, firefighters or others to mix and apply fire-protective gel or foam to entities such as structures, vehicles, vegetation, etc. For example, in one implementation, the FirePOD is instantiated as a self-contained portable device for mixing and applying fire-protective substances. In this instantiation, the FirePOD includes a recirculation mixer coupled to a frame of the self-contained portable device. This recirculation mixer further comprises a fluid pump having an inlet fluidically coupled to a storage and mixing tank, a first port of a first adjustable multi-position valve fluidically coupled to an outlet of the fluid pump, a proximal end of a return line fluidically coupled to a second port of the first multi-position valve, a distal section of the return line fluidically coupled, and extending into the storage and mixing tank, with the distal section of the return line further comprising one or more outlet nozzles configured to increase turbulence within the storage and mixing tank. In addition, a proximal end of a delivery line is fluidically coupled to a third port of the first multi-position valve. In a recirculation mode of this instantiation of the FirePOD, the first multi-position valve is adjusted to cause fluidic coupling between the first port and the second port, thereby causing the fluid pump to recirculate a mixture comprising a fluid and a concentrate from the storage and mixing tank, through the fluid pump, through the first multi-position valve, through the return line, through the one or more outlet nozzles and back into the storage and mixing tank until the mixture is fully mixed. In addition, in a delivery mode of this instantiation of the FirePOD, the first multi-position valve is adjusted to cause fluidic coupling between the first port and the third port, thereby causing the fluid pump to deliver the fully mixed mixture from the storage and mixing tank, through the fluid pump, through the first multi-position valve, and through the delivery line.

Similarly, in another implementation, the FirePOD is instantiated as a system comprising a frame, a storage and mixing tank coupled to the frame. This instantiation of the FirePOD further includes a fluid pump having an inlet fluidically coupled to an outlet of the storage and mixing tank, a first port of a first adjustable multi-position valve fluidically coupled to an outlet of the fluid pump. In addition, a proximal end of a return line is fluidically coupled to a second port of the first multi-position valve. Further, a distal section of the return line is fluidically coupled, and extending into, the storage and mixing tank, with the distal section of the return line further comprising a plurality of outlet nozzles configured to increase turbulence within the storage and mixing tank. Additionally, in this instantiation of the FirePOD, a proximal end of a delivery is line fluidically coupled to a third port of the first multi-position valve. Given these devices and connections, the FirePOD applies the storage and mixing tank, the fluid pump, the first adjustable multi-position valve, the return line, and the plurality of outlet nozzles to mix a fluid and a concentrate by adjusting the first multi-position valve to cause fluidic coupling between the first port and the second port, thereby causing the fluid pump to recirculate the fluid and concentrate from the storage and mixing tank, through the fluid pump, through the first multi-position valve, through the return line, through the plurality of outlet nozzles and back into the storage and mixing tank until the fluid and a concentrate are fully mixed. Then, responsive to the full mixing of the fluid and concentrate, this instantiation of the FirePOD applies the storage and mixing tank, the fluid pump, the first adjustable multi-position valve, and the delivery line to deliver the fully mixed fluid and concentrate by adjusting the first multi-position valve to cause fluidic coupling between the first port and the third port, thereby causing the fluid pump to deliver the fully mixed fluid and concentrate from the storage and mixing tank, through the fluid pump, through the first multi-position valve, and through the delivery line.

Similarly, in another implementation, the FirePOD is instantiated as a method that begins operation by applying a fluid pump fluidically coupled to a storage and mixing tank, a multi-position valve fluidically coupled to the fluid pump, a return line fluidically coupled to the multi-position valve, and one or more return nozzles fluidically coupled to the return line to recirculate a fluid and a concentrate through the fluid pump, the storage and mixing tank, the first multi-position valve, the return line and the return nozzles to fully mix the fluid and concentrate. Responsive to the full mixing of the fluid and concentrate, the FirePOD then applies the same fluid pump, the same storage and mixing tank, and same the multi-position valve to deliver the fully mixed fluid and concentrate via a delivery line fluidically coupled to the first multi-position valve. In addition, the FirePOD then applies an electronically powered drive system to power a movable base coupled to a frame, with the frame in turn being coupled to at least the storage and mixing tank. Finally, in this implementation, the FirePOD applies a local computing system to control the drive system and movable base for positioning the frame with the coupled storage and mixing tank and the fluidically coupled fluid pump, multi-position valve, return line and delivery line.

The FirePOD described herein provides various techniques for implementing a self-contained, portable, stand-alone fire protection system that enables property owners, firefighters or others to mix and apply a fire-protective gel or foam to entities such as structures, vehicles, vegetation, etc., to protect those entities from an impending wildfire event or other fire incident. In addition to the benefits described above, other advantages of the FirePOD will become apparent from the detailed description that follows hereinafter.

BRIEF DESCRIPTION OF THE DRAWINGS

The specific features, aspects, and advantages of the claimed subject matter will become better understood with regard to the following description, appended claims, and accompanying drawings where:

DETAILED DESCRIPTION

Figure 1:
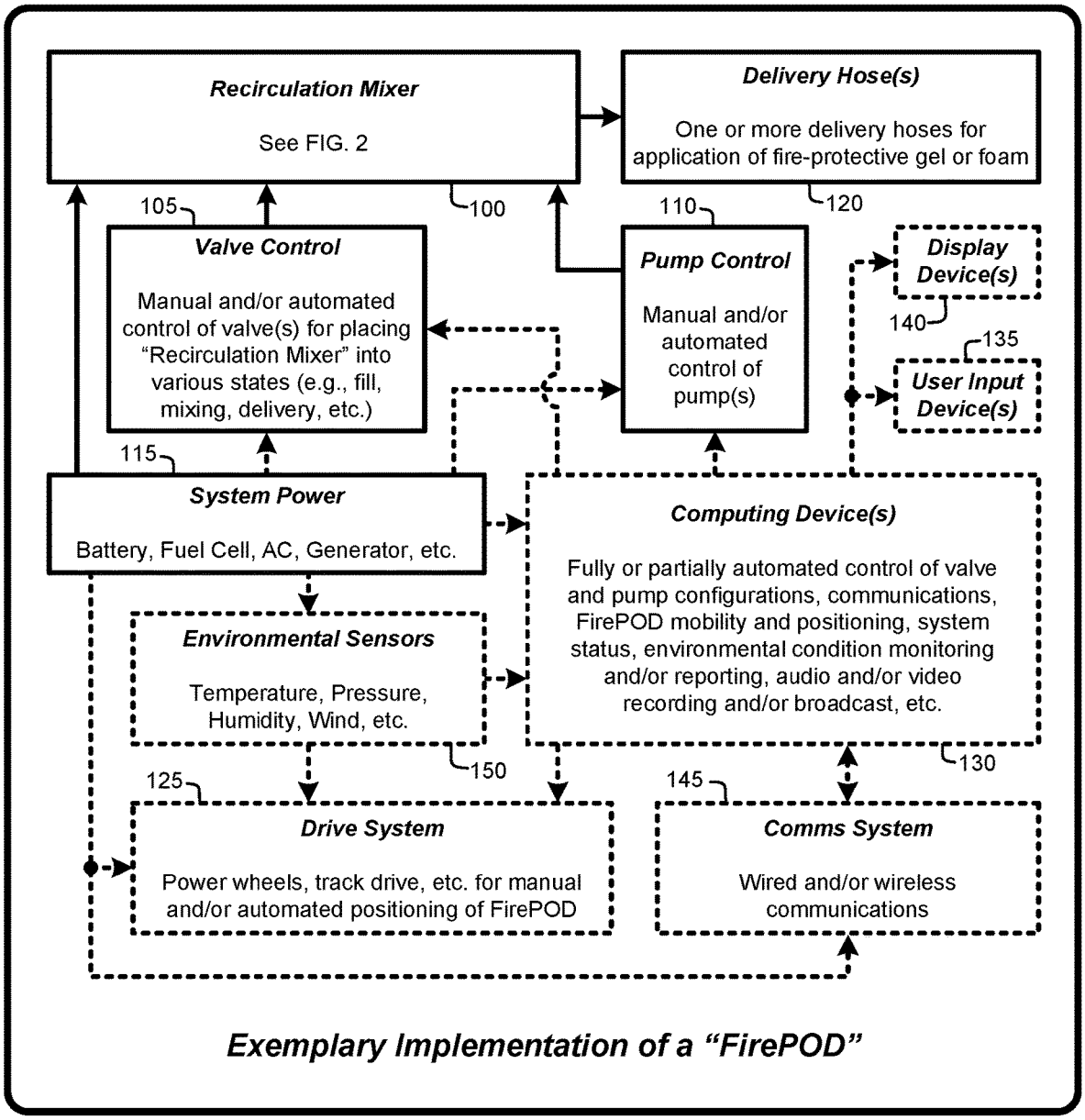
FIG. 1 provides an exemplary architectural flow diagram that illustrates hardware and optional computing devices and subprograms for implementing a "Fire Protection On Demand" (FirePOD) system or device for mixing and applying fire-protective gel or foam to entities such as structures, vehicles, vegetation, etc.

In the following description of various implementations of a "Fire Protection On Demand" system or device, also referred to herein as a "FirePOD," reference is made to the accompanying drawings, which form a part hereof, and in which is shown by way of illustration specific implementations in which the FirePOD may be practiced. Other implementations may be utilized, and structural changes may be made, without departing from the scope thereof.

Specific terminology will be resorted to in describing the various implementations detailed herein, and it is not intended for these implementations to be limited to the specific terms so chosen. Furthermore, it is to be understood that each specific term includes all its technical equivalents that operate in a broadly similar manner to achieve a similar purpose. Reference herein to "one implementation," or "another implementation," or an "exemplary implementation," or an "alternate implementation" or similar phrases, means that a particular feature, a particular structure, or particular characteristics described in connection with the implementation can be included in at least one implementation of the FirePOD. Further, the appearance of such phrases throughout the specification are not necessarily all referring to the same implementation, and separate or alternative implementations are not mutually exclusive of other implementations. The order described or illustrated herein for any devices, connections, interactions or process flows representing one or more implementations of the FirePOD does not inherently indicate any requirement for those devices, connections, interactions or process flows to be implemented in the order described or illustrated, and any such order described or illustrated herein for any devices, connections, interactions or process flows does not imply any limitations of the FirePOD.

As utilized herein, the terms "component," "system," "client" and the like are intended to refer to a computer-related entity, either hardware, software (e.g., in execution), firmware, or a combination thereof. For example, a component can be a process running on a processor, an object, an executable, a program, a function, a library, a subroutine, a computer, or a combination of software and hardware. By way of illustration, both an application running on a server and the server can be a component. One or more components can reside within a process and a component can be localized on one computer and/or distributed between two or more computers. The term "processor" is generally understood to refer to a hardware component, such as a processing unit of a computer system. In addition, the term "component" or other similar terms may also be used herein to refer to one or more physical elements of mechanical devices or mechanical systems associated with or comprising the FirePOD system.

Furthermore, to the extent that the terms "includes," "including," "has," "contains," variants thereof, and other similar words are used in either this detailed description or the claims, these terms are intended to be inclusive in a manner similar to the term "comprising" as an open transition word without precluding any additional or other elements.

1.0 Introduction

In general, the FirePOD provides a self-contained, portable, standalone fire protection system that enables property owners, firefighters or other users to quickly mix and apply fire-protective gel or foam to entities such as structures, vehicles, vegetation, etc., via one or more hoses or other dispensing mechanisms. The applied fire-protective gel or foam then serves to protect those entities from wildfire events or other external fire incidents. In various implementations, the FirePOD includes a recirculation-based mixing system that combines one or more compounds comprising a powder-, liquid-, or gel-based Thermal Protective Substance (TPS) or other concentrate or substance with a volume of water (or other fluid) to produce a mixture comprising the fire-protective gel or foam (or other mixture). For purposes of discussion, any powder-, liquid-, or gel-based TPS or any other substance to be mixed with water (or other fluid) to produce the fire-protective gel or foam or other substance will be referred to herein as a "TPS." Typically, to ensure efficacy of the fire-protective gel or foam, the TPS is mixed with water to form the fire-protective gel or foam at the time of, or shortly prior to, application of the fire-protective gel or foam. When properly applied, the fire-protective gel or foam creates a thermal protective coating that inhibits ignition of the entity to which that coating has been applied.

In various implementations, the FirePOD comprises various housing or frame configurations and various base configurations. For example, a housing or frame for connecting, holding, and/or protecting the various components of the FirePOD may have either a fixed or adjustable size to accommodate water storage tanks or other components of different sizes or weights. This housing or frame optionally includes attachment points such as, for example, lift hooks, eye bolts, etc. for crane or helicopter delivery of the FirePOD to difficult to reach or remote locations) or tow hooks, trailer hitches, or other attachment points to enable ground-based vehicles to tow or push the FirePOD into position. Further, in various implementations, the FirePOD includes a variety of base configurations (e.g., wheels, skids, tracks, pallet bases, etc.) to enable manual and/or automatic movement or positioning of the FirePOD to any desired location.

In addition to the use of different frame and base configurations, in various implementations, the FirePOD further comprises one or more tanks or containers for storing or receiving a volume of water or other fluid, and within which recirculation-based mixing is performed. The FirePOD also includes a power source, such as, for example, a combustion engine, fuel cell, generator, battery, connection to external electrical AC or DC power source, etc., for powering one or more pumps, manual and/or automatic valves, gauges, local computing devices, local communications devices, etc. Further, the FirePOD includes one or more pumps, and a plumbing manifold system having one or more reconfigurable valves and ports, and one or more inlet and outlet ports or connectors. In various implementations, one or more hoses, with optionally coupled delivery nozzles, are coupled to one or more of the ports or connectors of the plumbing manifold system downstream of one or more of the pumps to enable the application of fire-protective gel, foam or other substance to entities such as structures, vehicles, vegetation, etc. In various implementations, the TPS is either contained in a separate storage tank or container of the FirePOD for manual or automatic addition to the water tank or container for recirculation-based mixing, or is manually added to the water tank or container via a port, hatch, cap, or other opening into the water tank or container prior to recirculation-based mixing.

Advantageously, the recirculation-based mixing system of the FirePOD improves user safety by quickly mixing stored water with the TPS to prepare the fire-protective gel or foam, thereby reducing the time that a user might spend in a potentially dangerous area in the path of an oncoming fire. In general, one or more reconfigurable valves and one or more pumps of the FirePOD are applied to both recirculate the mixture and, when sufficiently mixed, to apply the resulting fire-protective gel or foam to one or more entities. In other words, mixing of the water and TPS is achieved via recirculation of the water and TPS through one or more pumps that both draw and replenish the mixture to and from a water tank or container until such time as the water and TPS are sufficiently mixed to form the fire-protective gel or foam. The same pump and valves are then configured to apply the fire-protective gel or foam. Advantageously, the shared use of reconfigurable valves and pumps for both mixing the water and TPS, and for application of the resulting fire-protective gel or foam, further improves user safety by reducing the complexity of rapidly generating and applying the fire-protective gel or foam. As a further advantage, this recirculation-based mixing system is capable of continuously pumping the water and TPS mixture to and from the storage tank even though that mixture exhibits a significant increase in viscosity during the mixing process.

In various implementations, some or all of the functionality of the FirePOD is partially or fully automated via one or more local and/or remote computing devices that are in communication with the FirePOD via any known wired or wireless communications modality (e.g., ethernet, Wi-Fi, radio, cellular communications, Bluetooth, microwave, etc.). In various implementations, control of various configurations and functions of the FirePOD via such computing devices is achieved via local interaction with and control of those computing devices, and/or via remote interaction with and control of those computing devices via a remote computer program or application running on a computing device.

1.1 System Overview

As mentioned, the FirePOD provides a self-contained, portable, standalone fire protection system that enables property owners, firefighters or other users to quickly mix and apply fire-protective gel or foam to entities such as structures, vehicles, vegetation, etc. The components and processes summarized above are illustrated by the general system diagram of FIG. 1. In particular, the system diagram of FIG. 1 illustrates the interrelationships between hardware components and optional programs and subprograms for instantiating various implementations of the FirePOD, as described herein. Furthermore, while the system diagram of FIG. 1 illustrates a high-level view of various implementations of the FirePOD, FIG. 1 is not intended to provide an exhaustive or complete illustration of every possible implementation of the FirePOD as described throughout this document. In addition, any boxes and interconnections between boxes that may be represented by broken or dashed lines in FIG. 1 represent alternate implementations or optional features of the FirePOD described herein. Further, any or all of these alternate implementations or optional features may be used in combination with any other implementations or optional features that are described throughout this document.

As illustrated by FIG. 1, in various implementations, the FirePOD includes a recirculation mixer 100 within which one or more compounds comprising a powder-, liquid-, or gel-based TPS or other concentrate or substance are mixed with a volume of water or other fluid. While the following discussion will generally refer to the use of the recirculation mixer 100 to produce a mixture comprising a fire-protective gel or foam, or the like, the recirculation mixer is fully capable of mixing any desired compounds with water or other liquids. Advantageously, other than the use of a pump, one or more reconfigurable valves and one or more return nozzles adapted to increase fluid turbulence, the recirculation mixer 100 does not require any moving parts, such as, for example, a motorized agitator or stirrer, or the like, to rapidly and thoroughly mix the TPS or other concentrate or substance with a volume of water or other fluid. As a result, energy demands of the recirculation mixer 100 are limited to powering the pump for recirculating the fluid and concentrate mixture during a mixing state of the recirculation mixer. The recirculation mixer 100 is described in further detail herein with reference to FIG. 2.

Referring back to FIG. 1, in various implementations, the recirculation mixer 100 is configurable via a valve control 105 and a pump control 110 to perform various functions. For example, in various implementations, the valve control 100 is applied to manually or automatically control or otherwise set a position of one or more valves of the recirculation mixer 100, thereby placing the recirculation mixer into various states, including a fill state (e.g., for filling a mixing or storage container or the like with water or other fluid), a mixing state (e.g., for recirculating the water or other fluid with TPS or other concentrate via one or more valves and pumps that both draw and return fluid and TPS or other concentrate to and from the mixing or storage container), a delivery state (e.g., delivering or applying the fire-protective gel or foam or other substance generated during the mixing state), etc. One or more delivery hoses 120 or delivery lines are coupled to the recirculation mixer 100 for delivery or application of the fire-protective gel or foam or other substance generated during the mixing state.

System power 115 (e.g., one or more DC batteries, capacitors, fuel cells, AC power, internal or external generator, solar cells, etc.) is included as a component of, or otherwise coupled to, the FirePOD to power various components of the FirePOD. For example, in various implementations, such components include, but are not limited to, the recirculation mixer 100 including one or more electronically controllable valves and one or more electric pumps (e.g., motor driven fluid pumps), an optional drive system 125 for powering wheels, track drives, or other locomotion device for manual and/or automatic positioning of the FirePOD, one or more optional computing devices 130, an optional communications system 145, and one or more optional environmental sensors 150 for monitoring any combination of temperature, pressure, humidity, wind speed, wind direction, etc.

As described in further detail herein, in various implementations, the computing devices 130 are configured to fully or partially automate control of valve and pump configurations, local and remote communications, FirePOD mobility and positioning, FirePOD system status, environmental condition monitoring and/or reporting, audio and/or video recording and/or broadcast, etc. In various implementations, one or more user input devices 135 are electronically coupled to, or otherwise in communication with, computing devices 130. Examples of such user input devices 135 include, but are not limited to, touchscreens, touch-sensitive surfaces, pointing devices, keyboards, audio input devices, voice or speech-based input and control devices, video input devices, haptic input devices, devices for receiving wired or wireless data transmissions, and the like, or any combination of such devices.

In various implementations, one or more display devices 140 are electronically coupled to, or otherwise in communication with, computing devices 130. In additional implementations, the communications system 145 is electronically coupled to, or otherwise in communication with, the computing devices 130 to provide wired and/or wireless communications between local and remote users or sites. In various implementations, the communications system 145 also enables one or more remote computing devices, computer programs, or applications to remotely control, monitor, or otherwise interact with some or all of the various components of the FirePOD. Alternately, in various implementations, the communications system 145 provides a standalone communications capability without requiring a wired or wireless connection to the computing devices 130.

2.0 Operational Details of the Firepod

The above-described devices, components, programs and subprograms, etc., are employed for instantiating various implementations of the FirePOD. As summarized above, the FirePOD provides a self-contained, portable, standalone fire protection system. The following sections provide a detailed discussion of the operation of various implementations of the FirePOD, and of exemplary methods and techniques for implementing the physical components and various features of programs and subprograms described in Section 1 with respect to FIG. 1. In particular, the following sections provides examples and operational details of various implementations of the FirePOD, including:

An operational overview of the FirePOD;
Recirculation mixer and FirePOD plumbing;
Positioning and movement of the FirePOD;
Application-based control of the FirePOD;
FirePOD power;
Local or remote sensor monitoring; and
Considerations for local and remote computing resources.

2.1 Operational Overview

As mentioned, the FirePOD provides a self-contained, portable, standalone fire protection system that enables property owners, firefighters or other users to quickly mix and apply fire-protective gel or foam to entities such as structures, vehicles, vegetation, etc., to protect those entities from wildfire events or other external fire incidents.

In various implementations, the FirePOD includes a recirculation-based mixing system for combining a mixture comprising a powder, liquid, or gel-based TPS or other concentrate or substance with a volume of water or other liquid in a storage tank or container to produce the fire-protective gel or foam or other mixed substance. By applying one or more reconfigurable valves, one or more pumps are applied to both recirculate the mixture (e.g., pump water and TPS from and back into the storage tank) and, when sufficiently mixed, apply the resulting fire-protective gel or foam to one or more entities via one or more hoses or other dispensing mechanisms. Factors such as, for example, available electrical power, pump strength, delivery hose length and diameter, number of active delivery hoses, nozzle types, mixing and storage tank size, etc., effect performance of the FirePOD with respect to delivery or application of the fire-protective gel or foam to a structure or other entity. For purposes of discussion, the following text will generally refer to the use of a centrifugal pump. However, the FirePOD may be configured with any desired type of fluid pump, including, but not limited to, centrifugal pumps, positive-displacement pumps, circumferential-piston pumps, diaphragm and bellows pumps, gear pumps, lobed pumps, flexible-vane pumps, nutating pumps, peristaltic pumps, volute and diffuser pumps, propeller and mixed-flow pumps, peripheral pumps, etc., without departing from the scope of the concepts described herein.

In various implementations, the FirePOD includes an onboard power system for providing AC and/or DC electrical power to various system components. In addition, the FirePOD is movable via tracks, wheels, skids, etc., such that it can be manually or automatically propelled to locations suitable for applying the fire-protective gel or foam. Further, in various implementations, the FirePOD includes either or both communications and computing capabilities to enable operations such as local and remote communications, local and remote control of various features and capabilities of the FirePOD, movement or positioning of the FirePOD, recording and/or reporting of audio, video, and/or local environmental conditions, etc.

For purposes of discussion, consider the following non-limiting use example of the FirePOD with respect to a residential structure. In particular, consider an exemplary FirePOD configuration concurrently using two separate 1.5-inch delivery hoses, each on the order of about 100 feet in length and each having firefighting fog nozzles, a commercially available AC powered centrifugal pump and one or more commercially available 12V batteries (optionally connected to an inverter for providing AC power to the pump). Prior to mixing of the water and TPS or other fluid/concentrate combination, the FirePOD storage tank or container is filled with water or other fluid. Then, when an impending wildfire event or other fire incident starts (or at any suitable time while it is safe for a user to remain in the area around the FirePOD), a prescribed amount TPS or other concentrate is manually or automatically added to the storage tank or container, at which time the recirculation-based mixing process is initiated.

Given this exemplary configuration, it has been observed that the FirePOD is easily capable of mixing, and then delivering or applying fire-protective gel or foam via both hoses (at the same time) to a height of at least 30 feet (e.g., more than the peak roof height of a typical two-story residential structure). Similarly, in addition to reaching heights of at least 30 feet, the spray of fire-protective gel or foam in this exemplary configuration has been observed to reach horizontal distances of at least 30 feet. Considering the length of the delivery hoses, this enables the FirePOD to deliver or apply fire-protective gel or foam to a distance of at least 130 feet in any approximately horizontal direction from the position of the FirePOD. In the case that only a single hose is used for delivery of fire-protective gel or foam by the FirePOD, the exemplary height and horizontal spray distances achievable by the FirePOD are approximately doubled. Further, in this example, reducing the diameter of the hose (e.g., using a 1-inch hose diameter) increases the throw distance of that hose relative to a 1.5-inch hose for delivery of fire-protective gel or foam, or any other fluid.

Advantageously, given a hose length of 100 feet and a spray distance of at least 30 feet for the dual hose configuration, the FirePOD is capable of coating the roof and all exterior walls of most typical residential structures from a single position by simply moving the hose or hoses as needed while applying the fire-protective gel or foam to the structure without requiring movement of the position of the FirePOD. Clearly, the FirePOD can be repositioned, and different hose lengths and diameters used, for delivery of fire-protective gel or foam as needed to cover some or all of any number of structures or other entities of any size.

Advantageously, in various implementations, the FirePOD is placed into a standby mode or the like, wherein the FirePOD has a partially or fully filled storage tank or container (either fully mixed or waiting for manual or automatic initiation of the recirculation-based mixing mode). The FirePOD can then be immediately deployed by the user or any firefighter or other safety personnel to protect nearby structures or entities. For example, assume that the FirePOD is used to apply a fire-protective gel or foam, or other substance, to a residential structure. The user can then refill the storage tank or container (and optionally initiate mixing mode) and then evacuate the area while leaving the ready-to-use FirePOD for use by Firefighters or other safety personnel. As such, the FirePOD can be used to protect structures or other entities by any person (e.g., firefighters, police, and others) having access to the FirePOD, or by remotely controlling various FirePOD features via various wired and/or wireless communications. The ready availability of such pre-positioned FirePOD resources increases the likelihood that a particular structure will be protected by firefighting personnel or others during a wildfire or other fire event.

2.2 Recirculation Mixer and Firepod Plumbing

Prior to an impending fire reaching a structure or other entity, a mixing mode of the FirePOD for mixing water or other fluid with TPS or other concentrate is initiated either manually or automatically. Depending upon the characteristics of the resulting fire-protective gel or other substance (e.g., efficacy time after mixing, viscosity changes during and after mixing, etc.), mixing or remixing of that substance by the recirculation mixer of the FirePOD is initiated at a suitable time. For example, in the case of mixing any of a number of commercially available thermal protective substances with water, it has been observed that the recirculation mixer of the FirePOD sufficiently mixes TPS and water to generate a fire-protective gel or foam within a period on the order of about 5 minutes. Depending upon power available to the FirePOD (e.g., external or onboard electrical power, battery, generator, etc.), mixing may be initiated prior to, during, or after positioning of the FirePOD at a suitable location for delivery or application of the fire-protective gel or foam.

In general, the mixing mode of the FirePOD causes plumbing and one or more pumps of the FirePOD to recirculate the fluid/concentrate mixture until such time as the fluid and concentrate are sufficiently mixed. For example, in various implementations, this recirculation of fluid and concentrate is accomplished by applying a centrifugal pump or the like, and a plumbing manifold including inlet and outlet ports and/or lines and one or more manually or automatically configurable multi-position valves, to draw the fluid/concentrate mixture from, and back into, the storage tank or container until the fluid and concentrate are sufficiently mixed.

With respect to returning the fluid/concentrate mixture to the storage tank or container during the recirculation process, in various implementations, a return line of the FirePOD extends into the storage tank. A section of the return line extending into the tank further includes one or more return nozzles configured to perform several actions. For example, in various implementations, the return nozzles are configured to perform actions including, but not limited to, any or all of: 1) directing a portion of the flow from one or more of the return nozzles towards a tank outflow port or drain (from which the pump draws the mixture during the recirculation process) to prevent a buildup of concentrate at or near the outflow port or drain, thereby reducing a possibility of clogging or other failures associated with viscous mixtures flowing within the tank, pump and associated valves and lines; 2) increasing turbulence in the storage tank or container to improve mixing; and 3) preventing or disrupting laminar flow within the storage tank or container, thereby reducing mixing time.

Determination of whether mixing is complete is accomplished via a variety of techniques. For example, completion of mixing is achieved by operations, including, but not limited to, recirculation of the fluid and concentrate mixture for a prescribed period of time, recirculation of the fluid and concentrate mixture until an automatically measured viscosity of that fluid/concentrate mixture reaches a prescribed level, recirculation of the fluid and concentrate mixture until an automatically measured increased power draw of the pump (in response to viscosity increase of the fluid/concentrate mixture) reaches a predetermined level, recirculation of the fluid and concentrate mixture until an automatically measured viscosity-based pressure increase within the pump and/or within a pump return line reaches a predetermined level, etc.

Advantageously, the use of one or more configurable multi-position valves enables the recirculation mixer to use the same pump to both mix and deliver fire-protective foam or other substance without first priming delivery lines of the FirePOD for delivering or applying the fire-protective gel, foam or other substance subsequent to the mixing operation. As such, the pump is protected from a potentially damaging dry running state. In particular, after the fluid and concentrate have been sufficiently mixed, one or more configurable multi-position valves of the FirePOD are configured to place the FirePOD in a delivery mode. In general, during this delivery mode, the same pump (or pumps), and one or more of the multi-position valves applied to achieve the recirculation-based mixing, are configured to cause the FirePOD to pump the resulting fire-protective gel or foam, or other substance, from the storage tank or container and then through one or more hoses, lines or pipes, each having optional spray or fog nozzles or the like, for application or delivery to entities such as structures, vehicles, vegetation, etc. If the storage tank or container of the FirePOD is emptied or expended during the delivery or application process, the processes summarized above (e.g., fill with water or other fluid, initiate recirculation-based mixing of fluid and concentrate, and initiate delivery or application of the resulting fire-protective gel or foam, or other substance), can be repeated as many times as necessary. In addition, if the storage tank or container of the FirePOD is emptied or expended during the delivery or application process, power to the pump can be automatically terminated to prevent a potentially damaging dry running state.

Figure 2:
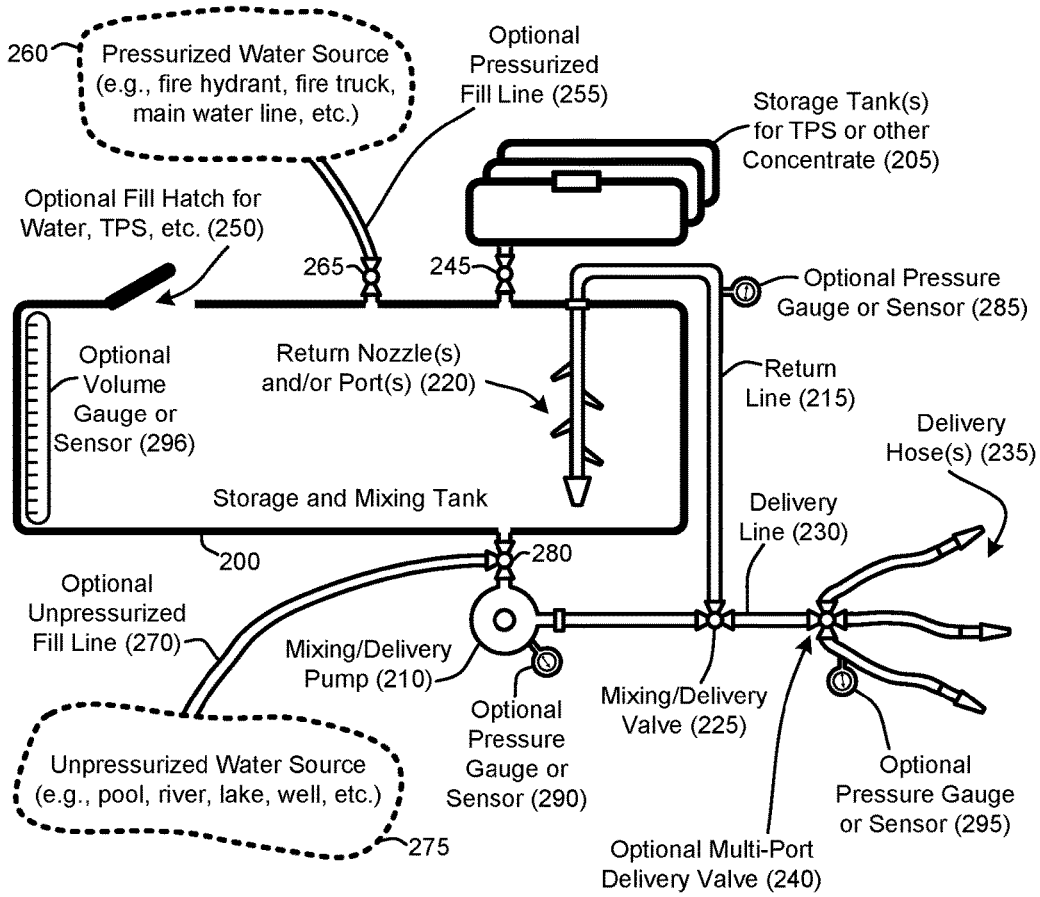
FIG. 2 provides an exemplary structural diagram that illustrates a "recirculation mixer" component for effecting various implementations of the FirePOD, as described herein.

Various features of the recirculation-based mixing described above are illustrated by the structural diagram of FIG. 2. For example, as illustrated by FIG. 2, in various implementations, the recirculation mixer includes a storage and mixing tank 200 for storage of water or other fluid. As discussed, the storage and mixing tank 200 also provides a storage volume for recirculation-based mixing of water or other fluid with TPS or other concentrate. In various implementations, a size of the storage and mixing tank 200 ranges from about 200 to about 600 gallons. However, there are no size or shape limitations of the storage and mixing tank 200 inherent in the FirePOD, and larger or smaller tanks may be used without departing from the scope of the FirePOD as described herein. In various implementations, one or more separate storage tanks 205 are included for storage of TPS or other single- or multipart-concentrate prior to mixing.

In addition, the recirculation mixer includes one or more mixing/delivery pumps 210, and a return line 215 for returning the mixture of water or other fluid and TPS or other concentrate from an outlet of the pump to an inlet of the storage and mixing tank 200 via one or more return nozzles or ports 220. In various implementations, a mixing/delivery valve 225 is configured to pass fluid mixtures exiting the pump 210 to the return line 215 for return to the storage and mixing tank 200 via return nozzles or ports 220. As mentioned, these return nozzles or ports are configured to perform actions including, but not limited to, preventing buildup of concentrate at or near the mixing tank 200 outflow port or drain, increasing turbulence in the mixing tank, preventing or disrupting laminar flow within the mixing tank, etc.

Further, subsequent to mixing the fluid and concentrate via recirculation, in various implementations, the mixing/delivery valve 225 is configured to enable the pump 210 to deliver the resulting fire-protective gel or other substance from the storage and mixing tank 200 to one or more delivery hoses 235. In various implementations, one or more of these delivery hoses 235 include optional spray and/or fog nozzles or other nozzle types for application of fire-protective gel or other substance. In various implementations, an optional multi-port delivery valve 240 is provided to enable alternate or concurrent use of one or more of the delivery hoses 235. In other words, the multi-port delivery valve 240 enables the FirePOD to concurrently use one or more delivery hoses 235 to apply the fire-protective gel, foam or other substance.

Advantageously, the concurrent use of two or more delivery hoses 235 enables two or more users to concurrently apply fire-protective gel, foam, or other substance from different user locations, thereby reducing the time needed to fully coat a structure or other entity with that fire-protective gel, foam, or other substance. Further, pre-deploying the delivery hoses 235 on different sides of a structure or positioned with respect to two or more different structures or entities, enables firefighters or others arriving on the scene to quickly apply the FirePOD for firefighting or fire prevention purposes without needing to position hoses or other resources for such purposes. Similarly, even with only a single user, the use of the optional multi-port delivery valve 240 enables two or more delivery hoses to be pre-deployed in different directions (e.g., on either side of a house). That single user can then use one of the hoses 235 to apply the fire-protective gel, foam, or other substance to one side of the house, switch the optional multi-port delivery valve 240 to close the valve to the hose currently in use while opening the valve to a different one of the hoses. As such, the user can quickly move from hose to hose to apply fire-protective gel, foam, or other substance without needing to drag or reposition potentially heavy hoses during a time-critical period in which there may be an oncoming wildfire or other fire event.

In various implementations, a concentrate valve 245 or the like is used to dispense TPS or other concentrate from the storage tank 205 into the storage and mixing tank 200 prior to mixing. In various implementations, the concentrate valve 245 is either manually operated or automatically operated to dispense a predetermined volume of TPS or other concentrate into the storage and mixing tank 200. Alternately, any desired amount of TPS or other concentrate is added to the storage and mixing tank 200 prior to mixing via an optional fill hatch 250, port, cap, etc.

The optional fill hatch 250 may also be used as an opening in the storage and mixing tank 200 for filling or refilling that tank with water or other fluid. Similarly, in various implementations, an optional pressurized fill line 255 is coupled to the storage and mixing tank 200 to fill or refill that tank from a pressurized water source 260 via one or more fill valves 265 configured to interface with hose connectors of various sizes and types (e.g., various firehose connectors, garden hose connector, etc.). Examples of pressurized water sources include, but are not limited to fire hydrants, fire truck water supplies, main water lines, municipal water supplies, etc. Similarly, in various implementations, an optional unpressurized fill line 270 is coupled to the storage and mixing tank 200 to fill or refill that tank from an unpressurized water source 275 via a fill valve 280 by drawing the unpressurized water via the mixing/delivery pump 210 in combination with the return line and the mixing/delivery valve 225, as illustrated. In related implementations, a portable or movable unpressurized water source can be coupled to the FirePOD as an external water source available for refill of the FirePOD, or as an additional water source for water-based firefighting efforts. For example, one or more tanks/containers on wheels, skids, tracks, etc., or even a second FirePOD, can be coupled to FirePOD (e.g., similar to train cars) so that the additional water source moves with FirePOD.

Advantageously, given the ability of the recirculation mixer to receive water from either or both a pressurized water source 260 and an unpressurized water source 275 via permanent and/or detachable plumbing connections, the mixing/delivery pump 210 can also be used to pump water from such sources, either directly or via the storage and mixing tank 200, through the delivery hoses 235 as a direct water-based firefighting approach whether or not TPS or other concentrate is available for mixing with that water. For example, the FirePOD can be positioned near a swimming pool or other unpressurized water source 275, with the optional unpressurized fill line 270 then being placed into that water source. The mixing/delivery pump 210 can then directly draw water from that unpressurized water source 275 and deliver that water via the mixing and delivery valve 225 to the delivery hoses 235. Advantageously, the same hoses or fill lines (255, 270) used for receiving water can also be coupled to valves or connectors of the FirePOD to act as the delivery hoses 235 for delivering the fire-protective gel, foam, or other substance, thereby limiting the number of hoses needed.

In various implementations one or more pressure gauges or sensors (285, 290, 295) are coupled to various lines and components of the recirculation mixer. For example, in one implementation, optional pressure gauge or sensor 285 is coupled to the return line 215 to monitor pressure within that return line. Similarly, in another implementation, optional pressure gauge or sensor 290 is coupled to the mixing delivery pump 210 to monitor pressure within that pump. Advantageously, the pressure gauge or sensor 290 can be used to provide instant feedback that the mixing/delivery pump 210 is primed and/or operating at nominal pressures. Similarly, in another implementation, optional pressure gauge or sensor 295 is coupled one or more of the delivery hoses 235 to monitor pressure within those hoses. In various implementations, the pressure gauges or sensors (285, 290, 295) are positioned such that either the actual gauges or sensors are visible to the user, or such that readouts from those gauges or sensors are visible to the user. Further, in various implementations, the computing device(s) 130 described with respect to FIG. 1 are applied to monitor pressures reported by any of the pressure gauges or sensors (285, 290, 295). This pressure information is then applied for use in actuating, stopping, opening, closing, or otherwise controlling any or all of the valves and pumps of the FirePOD or recirculation mixer.

For example, assume that a nozzle fails or disconnects from one of the delivery hoses 235 during application of fire-protective gel or foam, or that a hose fails due to bursting, being burned or being cut. Such failures or disconnects are likely to cause an immediate decrease in the pressure within the delivery hose 235 associated with the failure, thereby reducing (or eliminating) the distance or height to which the fire-protective gel or foam can be applied. In such case, the computing device(s) 130 described with respect to FIG. 1, or automatic pressure-actuated switches or the like, can perform a variety of actions to prevent loss of the fire-protective gel or foam. For example, the computing device(s) 130 described with respect to FIG. 1, or automatic pressure-actuated switches, can apply either or both the valve control 105 and pump control 110 described with respect to FIG. 1 to perform actions including, but not limited to, automatically stopping the pump, placing the FirePOD into a recirculation mode by automatically configuring the mixing/delivery valve 225, bypassing the hose having the failed or disconnected nozzle by configuring the optional multi-port delivery valve 240 to prevent flow through that hose, etc.

Similarly, in the event that pressure in any or all of the mixing/delivery pump 210, the return line 215 and/or any of the delivery hoses 235 increases to a level that can damage any component of the FirePOD, the computing device(s) 130 described with respect to FIG. 1, or automatic pressure-actuated switches, can perform a variety of actions to prevent such damage, including, but not limited to, removing system power, slowing or stopping the mixing/delivery pump 210, opening or otherwise configuring one or more of the mixing/delivery valve 225 or the optional multi-port delivery valve 240 to reduce pressure to a safe level etc.

In further implementations, an optional volume gauge or sensor 296 is applied to show or monitor fluid volume within the storage and mixing tank 200. In general, the optional volume gauge or sensor 296 can be implemented in various ways, including but not limited to, one or more cutouts or windows in the FirePOD to allow a user to visually observe fluid levels in the storage and mixing tank, a float gauge, or any other known volume sensor. In various implementations, the computing device(s) 130 described with respect to FIG. 1 apply volume information received from the optional volume gauge or sensor 296 to perform various actions, including, but not limited to, generating one or more alerts regarding current fluid level within the storage and mixing tank 200, initiating an automatic fill or refill of the storage and mixing tank 200 via either or both of the pressurized water source 260 and/or the unpressurized water source 275, stopping the mixing/delivery pump 200 to prevent dry running of that pump (which can seriously damage centrifugal pumps and the like), etc. Similarly, in various implementations, an electric float switch or the like (not shown) is positioned at or near the bottom of the storage and mixing tank 200. Advantageously, the float switch is configured to protect the mixing/delivery pump 210 by cutting power to the pump (or other FirePOD components) whenever a volume level of the storage and mixing tank 200 is low enough to risk the pump running dry or failing due to a lack of water or fluid pressure within the pump.

In related implementations, any of the pump and/or one or more lines or hoses of the FirePOD include pressure relief valves, switches, or the like to prevent the possibility of a potentially damaging excess pressure condition in the pump, delivery or recirculation lines, or any of the hoses. In such a case, one or more pressure-relief valves or switches operate to either relieve excess pressure, or to automatically stop the pump being used for either the recirculation-based mixing or subsequent delivery if the pressure is too high. In general, pressure ratings for commercial pumps, fluid lines, and hoses are readily available. As such, pressure relief valves and switches are configured to limit pressures in various components of the FirePOD to levels that are not likely to damage system components.

2.3 Positioning and Movement of the Firepod

In general, for storage, operational use (e.g., application of fire-protective gel, foam or other substance), moving the FirePOD to a water or fluid source for fill or refill operations, etc., the FirePOD is positioned in any desired location. Prior to, or during, operational use, the FirePOD is then positioned to allow for application or delivery of the fire-protective gel, foam or other substance based on considerations including, but not limited to, length of one or more delivery hoses, effective spray distance of nozzles coupled to the delivery hoses, available internal power resources (e.g., onboard batteries, fuel cells, etc.), available external power resources (e.g., extension cord from an external AC power source to the FirePOD), etc.

In various implementations, the FirePOD is manually and/or automatically movable or positionable via a variety of different base configurations (see Section 2.3.1 of this document) and optional drive system configurations (see Section 2.3.2 of this document). With respect to manual movement or positioning, in various implementations the FirePOD is equipped with wheels to enable the user to push, pull or tow the FirePOD to any desired location. Such wheels include any combination of features such as the ability rotate freely, swivel, and/or lock. With respect to the use of drive systems, in various implementations, the FirePOD is equipped with one or more motors or engines to provide drive power to one or more wheels, tracks, etc. In implementations including a drive system, various manual and/or automatic steering, throttle, braking, or other drive control mechanisms are provided for maneuvering the FirePOD to a desired location. Automatic control of various FirePOD controls and drive systems is discussed in further detail in Section 2.3.3 of this document.

2.3.1 FirePOD Base and Housing Configurations:

In general, a base platform of the FirePOD is fixed to, or removably coupled to, a housing or frame of the FirePOD. In combination, the base and housing of the FirePOD provide structure for both holding and connecting the various physical components of the FirePOD and enabling the FirePOD to be movable or positionable.

For example, in various implementations, the FirePOD is configurable with a variety of different base types. Examples of such bases include, but are not limited to, manual wheeled bases (including either or both swiveling and non-swiveling wheels), powered wheeled bases, powered continuous track-type bases, skid-type bases for pushing or pulling the FirePOD into position, combination track and skid bases (e.g., similar to a snowmobile having a front skid and a powered rear track), pallet type bases configured to accept forklift tines on one or more sides, floatable or pontoon-type bases to enable transport of the FirePOD via a waterway, a rotatable base that enables the FirePOD to be rotated for user convenience or operation, etc. In addition, in various implementations, a trailer or tow hitch is coupled to one or more sides of the FirePOD to enable an external vehicle (e.g., golf cart, ATV, automobile, boat, etc.) to pull the FirePOD to a desired location. Such tow hooks and hitches are typically used in FirePOD configurations that include wheeled bases, skid bases, tracked bases, and floating bases.

Advantageously, in various implementations, the base is removable to facilitate installation of the FirePOD in fixed locations. As a further advantage, in various implementations, some or all of the different base types described herein are interchangeable (e.g., replace a tracked base with a wheeled base or skid base). In other words, the base is reconfigurable to accept any or all of the various base types or features described herein.

Referring back to the housing of the FirePOD, in various implementations, the housing is a structural frame or the like that holds components such as the recirculation mixer and associated components, power supplies (e.g., batteries, fuel cells, generator and fuel, etc.), one or more hoses for receiving water or other fluids into the mixing and storage tank, one or more hoses for delivering fire-protective gel or other substance, communications devices, computing devices, safety lights or beacons, work lights, sensors, gauges, etc. In addition, in various implementations, the housing or frame of the FirePOD optionally includes a removable connected skin or panels covering any or all of the bottom, sides and top of the FirePOD. In general, the skin or panels are configured to protect the FirePOD frame and internal devices, power sources, computers, water and TPS storage tanks, supplies, etc. For example, in various implementations, the skin or panels are any or all of fire-proof, waterproof, and weatherproof. In various implementations, the skin or panels are customizable or paintable to match nearby structures or vegetation.

In further implementations, the housing and/or internal frame of the FirePOD, or any internal storage tanks or containers, include a heating mechanism or the like (e.g., resistive heating elements, thermoelectric heating elements, etc.). Such heating mechanisms are manually or automatically activated to keep internal components, including plumbing, pumps, storage tanks, etc., of the FirePOD above a freezing temperature in cases where local temperatures may drop below freezing. As such, these heating mechanisms prevent damage to internal components and ensure that fluids in storage tanks, lines, or hoses within the FirePOD do not freeze and are ready for deployment when needed.

In additional implementations, the FirePOD includes attachment points such as, for example, lift hooks, eye bolts, etc., for crane, helicopter, or drone delivery of the FirePOD to various locations, tow hooks, trailer hitches, handles, or other attachment points to enable ground-based vehicles (or the use of humans or draft animals) to tow or push the FirePOD into position, etc. As such, the combination of the housing or frame with a coupled base (e.g., wheeled base, tracked base, skid base, etc.), provides both a physical structure or support and a variety of mobility options for the FirePOD. Further, in various implementations, the housing or frame and/or the base of the FirePOD includes one or more lights and/or one or more visible or audible beacons.

Figure 3:
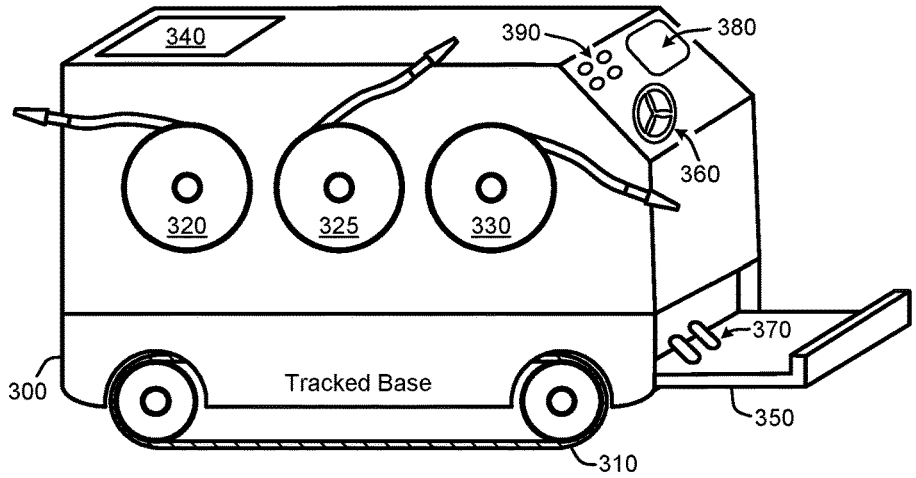
FIG. 3 illustrates an exemplary tracked vehicle FirePOD implementation, as described herein.
Figure 4:
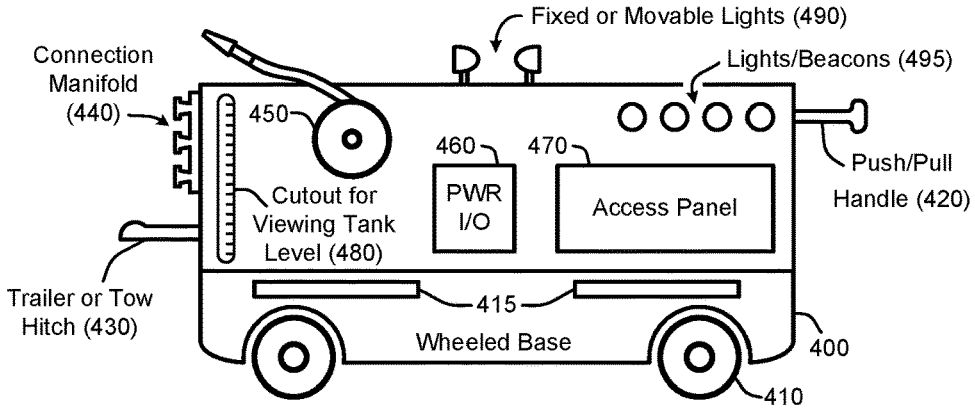
FIG. 4 illustrates and exemplary wheeled vehicle FirePOD implementation, as described herein.

FIGS. 3 and 4, described below, illustrate various structural combinations of FirePOD bases and housings (with various optional attached components).

Figure 5:
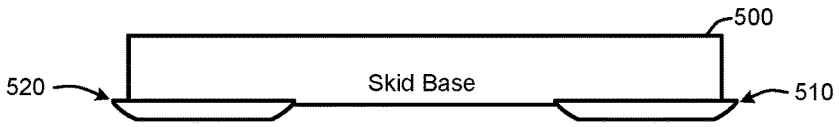
FIG. 5 illustrates an exemplary skid base implementation of the FirePOD, as described herein.

Similarly, FIG. 5 provides an example of one of the many different detachable bases of the FirePOD. FIG. 3 through FIG. 5 illustrate high-level views of various implementations of the FirePOD that are provided for purposes of explanation. As such, FIG. 3 through FIG. 5 are not intended to provide an exhaustive or complete illustration of every possible implementation or feature of the FirePOD as described throughout this document. Further, various components and features illustrated in any or all of FIG. 3 through FIG. 5 may be used with any of the various FirePOD implementations described throughout this document.

For example, as illustrated by FIG. 3, in various implementations, the FirePOD is configured with a tracked base 300 having one or more powered tracks 310 driven by one or more onboard electric or internal combustion motors (not shown). In addition, as illustrated by FIG. 3, in various implementations, the FirePOD includes multiple delivery hoses (320, 325, 330) on optional hose reels or the like. As mentioned, the storage and mixing tank of the FirePOD (not shown in FIG. 3) may include a hatch or opening 340 for filling that tank with water or other fluid and/or TPS or other concentrate. In various implementations, an optional driving platform 350 or the like enables a user to stand on the platform while driving the FirePOD to a desired location. As illustrated, this implementation of the FirePOD may also include a steering wheel 360 with left/right track controls or control joystick (not shown) and optional foot pedals 370 (e.g., brake, throttle, forward, reverse, etc.). In addition, in various implementations, the FirePOD includes a display screen 380 and various gauges, sensors, switches, and or controls 390 to for interacting with or viewing various statuses, components or operations of the FirePOD.

In other implementations, as illustrated by FIG. 4, the FirePOD includes a wheeled base 400 having wheels 410 that include either or both a set of optionally lockable swiveling wheels and/or one or more powered wheels. These wheels 410 enable the FirePOD to be pushed, pulled, towed or driven to a desired location. In various implementations, this wheeled base 400 (or any other base type) may include a pallet base or the like having one or more receptacles 415 or the like for receiving forklift tines to enable conventional forklifts or pallet jacks or the like to move the FirePOD. Further, in various implementations, the FirePOD includes a push/pull handle 420 or the like to enable a user to manually roll or otherwise maneuver the FirePOD to a desired position. Similarly, in the case of powered wheels 410, one or more of the wheels are powered via an electric or internal combustion-based drive system and associated drive controls (not shown), thereby enabling the user (or attached computing system) to drive or otherwise position the FirePOD to a desired location. In addition, as illustrated by FIG. 4, in various implementations, the FirePOD includes a trailer hitch or tow hitch 430, or the like, to enable the FirePOD to be driven to a desired position by a vehicle coupled to the trailer hitch or tow hitch.

In general, the wheels 410 can be of any desired size. Further, given the weight of a tank filled with potentially several hundred or more gallons of water or other fluid, various implementations of the FirePOD are configured with heavy duty swiveling all-terrain wheels or the like capable of supporting at least the maximum weight of the FirePOD having full tanks. In various implementations, the wheels 410 are either or both solid and/or designed to prevent or reduce a likelihood of melting (e.g., metal or composite wheels) under normal fire conditions.

In various implementations, the FirePOD includes a connection manifold 440 or the like to enable the connection of various sizes and types of fill hoses or delivery hoses (e.g., fire hoses, garden hoses, municipal water lines, etc., not shown) using any of a plurality of known hose connectors. Alternately, or in addition, in various implementations, the FirePOD may include one or more coupled hoses 450 for use as fill hoses and/or delivery hoses. As further illustrated by FIG. 4, in various implementations, the FirePOD includes a power input/output connector or panel 460 to either or both tap onboard power or provide external power to the FirePOD for either charging internal batteries of the FirePOD or for directly powering the FirePOD. Further, in various implementations, the FirePOD includes an access panel 470 or the like that provides user access to, and view of, various FirePOD components or controls (e.g., storage tanks, plumbing, pumps, valve control, power control, computing devices, communications devices, etc., not shown). In addition, in various implementations, the FirePOD includes a cutout 480 or window in the skin or cover panels that enables users to directly view a fluid volume in the mixing and storage tank, and or the storage tank or container holding TPS or other concentrate.

Finally, as illustrated by FIG. 4, in various implementations, the FirePOD includes one or more fixed or movable lights 490 and/or one or more visible or audible beacons 495. Advantageously, some or all of these lights 490 and beacons 495 illuminate, flash, strobe, or otherwise enable the user or safety personnel such as firefighters to quickly locate the FirePOD. In various implementations, one or more of the lights 490 are positionable, rotatable, removably coupled, or tethered to the housing or frame and/or the base of the FirePOD via a power cord or the like. As such, those lights 490 can be used as work lights, safety lights, portable flashlights, etc., thereby improving user safety in smoky or low light environments. While not a requirement, in various implementations, one or more of the lights 490 and/or beacons 495 emit green light. Research has shown that green light provides improved illumination and visibility relative to other light colors in low light and/or smoky conditions. In various implementations, one or more lights (not shown) are configured to illuminate a control panel, individual controls, or one or more internal components of the FirePOD for improved visibility in low light and/or smoky conditions.

In further implementations, as illustrated by FIG. 5, in various implementations, the FirePOD is configured with a skid base 500 or the like having one or more skids 510 and 520 to enable the FirePOD to be pushed or pulled to a desired location.

2.3.2 FirePOD Drive System:

As mentioned, in various implementations, an onboard drive system is provided as a component of the FirePOD. In general, the onboard drive system uses either or both an internal combustion engine or generator and/or an electric power supply (e.g., battery, fuel cell, AC and/or DC power supply, etc.) to power electric motors for driving wheels, tracks, etc., of various FirePOD base configurations. For example, various implementations of powered bases use any combination of components including, but not limited to, steering wheels, joysticks or the like, tethered or wireless control panels or remote controls, throttles, brakes, etc., to initiate or control movement or positioning of the FirePOD. In various implementations, control of the onboard drive system is accomplished via manual control, manually adjusted mechanical and/or electronic controls, local and/or remote software application-based control of the onboard drive system, etc., to position or move the FirePOD. As discussed in further detail in Section 2.3.3 of this document, in fully or partially automated configurations or implementations, the FirePOD uses one or more computing devices coupled to the FirePOD drive system to position or move the FirePOD. In general, these fully or partially automated implementations cause the FirePOD to move to one or more user-defined or predefined positions.

2.3.3 Automated Control of FirePOD Drive System:

In various implementations, the aforementioned computing device(s) (e.g., see FIG. 1) are applied to control one or motors or engines and some or all of the various drive control mechanisms of the FirePOD to enable automated positioning or deployment of the FirePOD to one or more predefined or user-defined positions. In additional implementations, the FirePOD is controllable and/or positionable via wired (e.g., tethered) or wireless remote-control devices or applications.

For example, in various implementations, an application or computer program running on a mobile computing device, smart phone, tablet, etc., may include a visual map of a yard or other environment, a real-time camera view of the yard or environment from the FirePOD, GPS receivers, etc., to enable remote driving of the FirePOD and/or automatic deployment of the FirePOD to one or more predefined or user-defined locations. In the case of a tethered remote-control device or the like, in various implementations an optional safety mechanism of the FirePOD automatically stops movement of the FirePOD if the tether is disconnected from remote-control device.

2.4 Application-Based Control of the Firepod

As mentioned above, in various implementations, some or all of the features and/or functions of the FirePOD may by controlled by one or more computing devices. As such, in various implementations, a remote application, running on any computing device (e.g., smart phone, tablet, desktop computer, etc.) communicates wirelessly with one or more controls, switches, or computing devices of the FirePOD for purposes of controlling, activating, or otherwise interacting with one or more features or functions of the FirePOD. Advantageously, in various implementations, as a redundant safety feature (e.g., loss of communications or computing capability of the FirePOD), some or all of the functionality of the FirePOD is fully configurable and usable via local manual user interaction with various components of the FirePOD.

For example, in various implementations, some or all of the functionality of the FirePOD is partially or fully automated via an application or computer program or the like running on one or more local and/or remote computing devices that are in communication with the FirePOD via any known wired or wireless communications modality (e.g., ethernet, Wi-Fi, radio, cellular communications, Bluetooth, microwave, etc.). In various implementations, control of various configurations and functions of the FirePOD via such computing devices is achieved via local interaction with and control of those computing devices, and/or via remote interaction with and control of those computing devices. Such local and/or remote control provides any combination of direct local control, local or remote app-based control via cell phones, tablet-type devices, or other computing resources, etc., that communicate with one or more computing or control devices of the FirePOD.

In various implementations, the app-based control provides partially or fully automated functionality of the FirePOD including, but not limited to, initiating mixing and/or application of the fire-protective gel or foam, configuring valve and/or pump states or configurations, initiating delivery of fire-protective gel, foam or other substance, initiating or otherwise providing two-way or multi-way voice and/or video communications between the remote application, communications equipment coupled to the FirePOD and/or communications with one or more local or remote third-party communications devices, positioning or movement of the FirePOD, monitoring and/or reporting of local environmental conditions observed or measured by various sensors coupled to or otherwise in communication with the FirePOD, monitoring and or reporting status of one or more components of the FirePOD, recording and/or transmission of audio, images, or video recorded by microphones and/or cameras coupled to or otherwise in communication with the FirePOD, etc.

With respect to two-way or multi-way voice and/or video communications, in various implementations, the FirePOD includes various communications systems. For example, in various implementations, the FirePOD includes a tunable two-way radio device, an integral cellular communications device, integral Wi-Fi, a mobile hotspot, etc., any or all of which can be used to maintain multi-party voice and/or video communications. Advantageously, some or all of these communications modalities also enable the FirePOD to report various sensor readings, system statuses, and/or a geographic or physical location of the FirePOD to the user or to any other remote system or application in communication with the FirePOD.

2.5 Firepod Power

In typical wildfire or other fire events, local utilities often intentionally cut electrical power to homes, businesses, and other entities for various safety reasons (e.g., downed live electrical lines) and to prevent additional fires or damage caused by burned electrical lines, failed transformers, etc. Further, the wildfire or other fire event may cause loss of local electrical power to homes, businesses, and other entities. As such, in various implementations, the FirePOD includes any of a variety of onboard power sources. In various implementations, the FirePOD includes multiple redundant power sources (e.g., batteries and fuel cells) such that if a primary power source fails or is depleted, the FirePOD automatically switches to a backup power source, as needed. Advantageously, these onboard power systems can be used both to power various functionality of the FirePOD and to provide onsite emergency external power to users, firefighters, or other safety personnel when needed.

For example, in various implementations, the FirePOD uses any combination of power sources including, but not limited to internal combustion engines, fuel cells, generators, batteries, connection to external electrical AC or DC power sources, etc. These power sources are adapted to power one or more drive systems, pumps, valves, gauges, local computing devices, local communications devices, etc. In the case of DC power provided by batteries, fuel cells, etc., in various implementations, the FirePOD includes an inverter or the like that is electrically coupled to the DC power source to provide AC power to various components (e.g., computing devices, pumps, etc.). External electrical connectors coupled to the FirePOD are provided in various implementations to provide AC and/or DC power to one or more devices external to the FirePOD. For example, an extension cord or device can be plugged into an external electrical connector of the FirePOD to obtain electrical power, as needed.

With respect to the use of batteries for powering the FirePOD, various battery types and configurations are available. For example, such battery types include, but are not limited to, lead-acid batteries, lithium ion batteries, nickel cadmium batteries, nickel metal hydride batteries, etc. Charging or recharging of these batteries is accomplished either as an automated or user-initiated process via various modalities, including, but not limited to, onboard or connected solar-powered trickle chargers or the like, AC to DC based charging systems using internal or external power sources, etc. In various implementations, whenever the FirePOD is connected to an external power source, charging or recharging of any or all onboard batteries of the FirePOD is automatically initiated via an onboard battery charger.

In the case of fuel cells or the like, in various implementations, the FirePOD include a fuel tank or the like for holding reaction fuel (e.g., hydrogen, methanol, methane, natural gas, etc.), depending upon the fuel cell type. Similarly, with respect to the use of onboard or coupled internal-combustion-based generators or the like, in various implementations, the FirePOD includes both a generator and fuel storage (e.g., gasoline, diesel, natural gas, propane, ethanol, etc.) for running the generator.

In addition to the power source, in various implementations, the FirePOD includes corresponding system wiring, junction boxes, fuses, manual and/or automatic switches and/or breakers, etc., for providing electrical power to some or all of the various components of the FirePOD. Wiring, junction boxes, switches, breakers, fuses, etc., for providing electrical power to various devices and components are well understood to those skilled in the art and will not be described in detail herein.

2.6 Local or Remote Sensor Monitoring

In various implementations, the FirePOD monitors various onboard and/or remote sensors or sensor information received from one or more internal or external sources (e.g., a local weather station or the like in wired or wireless communication with the FirePOD). This sensor monitoring enables the FirePOD, or one or more computing devices coupled to, or in communication with, the FirePOD to report, evaluate or react to local environmental conditions around the FirePOD, and to report, evaluate or react to onboard statuses, temperatures, pressures, etc., of the FirePOD and various components of the FirePOD. For purposes of explanation, various sensors will be described as if integral to the FirePOD. However, in various implementations, any or all such sensors are connected to the FirePOD, or to one or more computing devices coupled to the FirePOD, via any known wired or wireless communications interface.

For example, in various implementations, such sensors include, but are not limited to, any or all of the following:

a. Thermocouples or other temperature sensing devices (e.g., IR temperature sensors) for monitoring internal temperatures and local environmental temperatures;
b. Pressure sensors (including tire, pump, line and hose pressure sensors, and/or environmental pressure sensors);
c. Water or fluid level sensors;
d. Concentrate level sensors;
e. Power level sensors (e.g., battery levels, power draw, etc.);
f. Viscosity meters for monitoring viscosity of fluid in pumps, valves and various plumbing lines or hoses of the FirePOD;
g. Fuel gauges (e.g., pressure, volume, temperature, etc.);
h. Still or video cameras (e.g., fixed, directional, or 360-degree view around FirePOD); and
i. Microphones.

The FirePOD applies monitored sensor information for a variety of purposes, as discussed throughout this document. Such purposes include, but are not limited to, any or all of the following:

a. Automatically engaging or initiating various functionality of the FirePOD;
b. Monitoring status of various FirePOD components (e.g., mixing mode, delivery mode, valve positions, pressures, etc.);
c. Automatically moving or positioning the FirePOD;
d. Reporting local environmental conditions such as fire hotspots, wind speed, humidity, air temperature, etc., to the user, to a local fire department or other fire monitoring authority or organization, etc.;
e. Initiating automated calls to the user, local 911 emergency services, or others with an alert regarding detection of local fire events;
f. Record, store and/or broadcast or transmit still and/or video images to one or more subscribed users or devices;
g. Record, store and/or broadcast or transmit local audio data to one or more subscribed users or devices; and
h. Record, store, and or broadcast FirePOD deployment times and/or durations to one or more subscribed users or devices.

2.7 Considerations for Local and Remote Computing Resources

As mentioned, the FirePOD may be implemented in combination with one or more local or remote computing devices, local or remote servers, cloud-based computing systems, etc., in combination with various tracking, networking and communications modalities. Clearly, as will be well-understood by those skilled in the art, any or all of the computer-based or application-based features described throughout this document can be implemented via any desired combination of computational and communications resources. In particular, any one or more sufficiently capable (e.g., sufficient computational capacity, sufficient communications bandwidth, sufficient latency, etc.) computing devices, servers, or cloud-computing systems may be used to implement any or all of the features of the FirePOD as described herein without departing from the intended scope of the concepts described. As such, modifying, adapting, combining, networking, etc., communications and interactions between any one or more such computing devices, servers or cloud-computing systems for implementing any or all of the features of the FirePOD does not limit the subject matter of the FirePOD as described herein.

Figure 6:
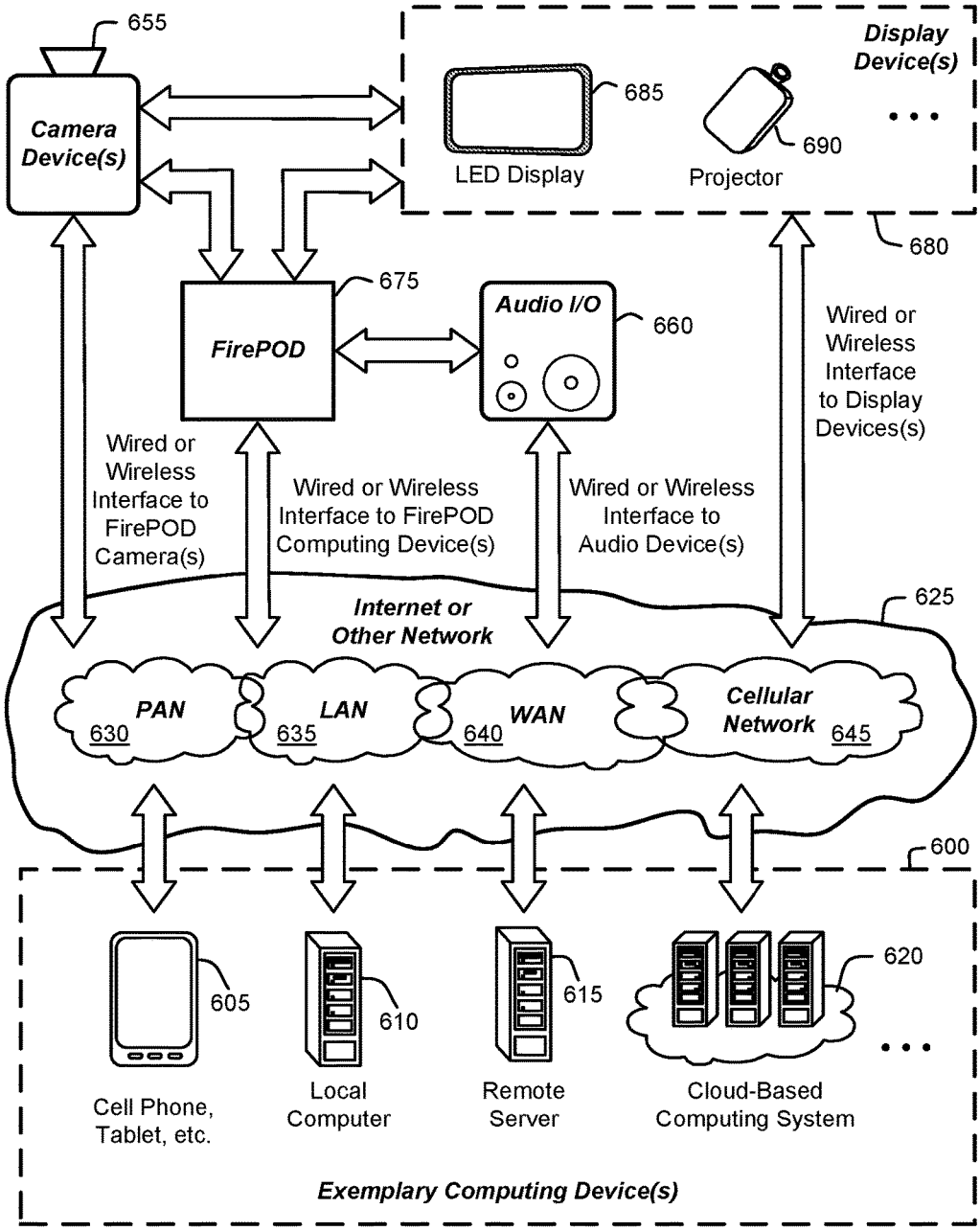
FIG. 6 illustrates a general system diagram that depicts a variety of alternative computing systems, communications interfaces, and other physical components and devices for use in effecting various implementations of the FirePOD, as described herein.

For example, as illustrated by FIG. 6, various processes enabled by the FirePOD are implemented by instantiating some or all of the control functionality of the FirePOD on one or more computing devices 600. Examples of computing devices 600 include, but are not limited to, local computing device 605 (e.g., cell phone, tablet, etc.), local computer 610, remote server 615, cloud-based computing system 620, or any other computing device or system having sufficient computational resources.

Some or all of these computing devices 600 are in communication with each other and/or in communication with the FirePOD 675 via various wired and/or wireless interfaces or protocols. In addition, the FirePOD 675 may be in communication with some or all of one or more camera devices 655, one or more audio input and/or output devices 660, one or more display devices 680 (e.g., LED display 685, projector device 690, etc.). Such communications are enabled via any of a wide range of communication and networking technologies. For example, such communications are enabled via the internet or other network 625, and include networks such as, for example, conventional wired or wireless networks including personal area networks (PAN) 630, local area networks (LAN) 635, wide area networks (WAN) 640, cellular network 645, etc., using any desired wired or wireless network topology (e.g., star, tree, etc.), connectivity, or protocol.

As discussed in further detail throughout Section 2 of this document, various semi- or fully automated implementations of the FirePOD operate in combination with any or all of the aforementioned computing devices 600 and networks 625 to provide control, statuses, communications, and/or interaction with the FirePOD.

3.0 Operational Summary of the Firepod

Figure 7:
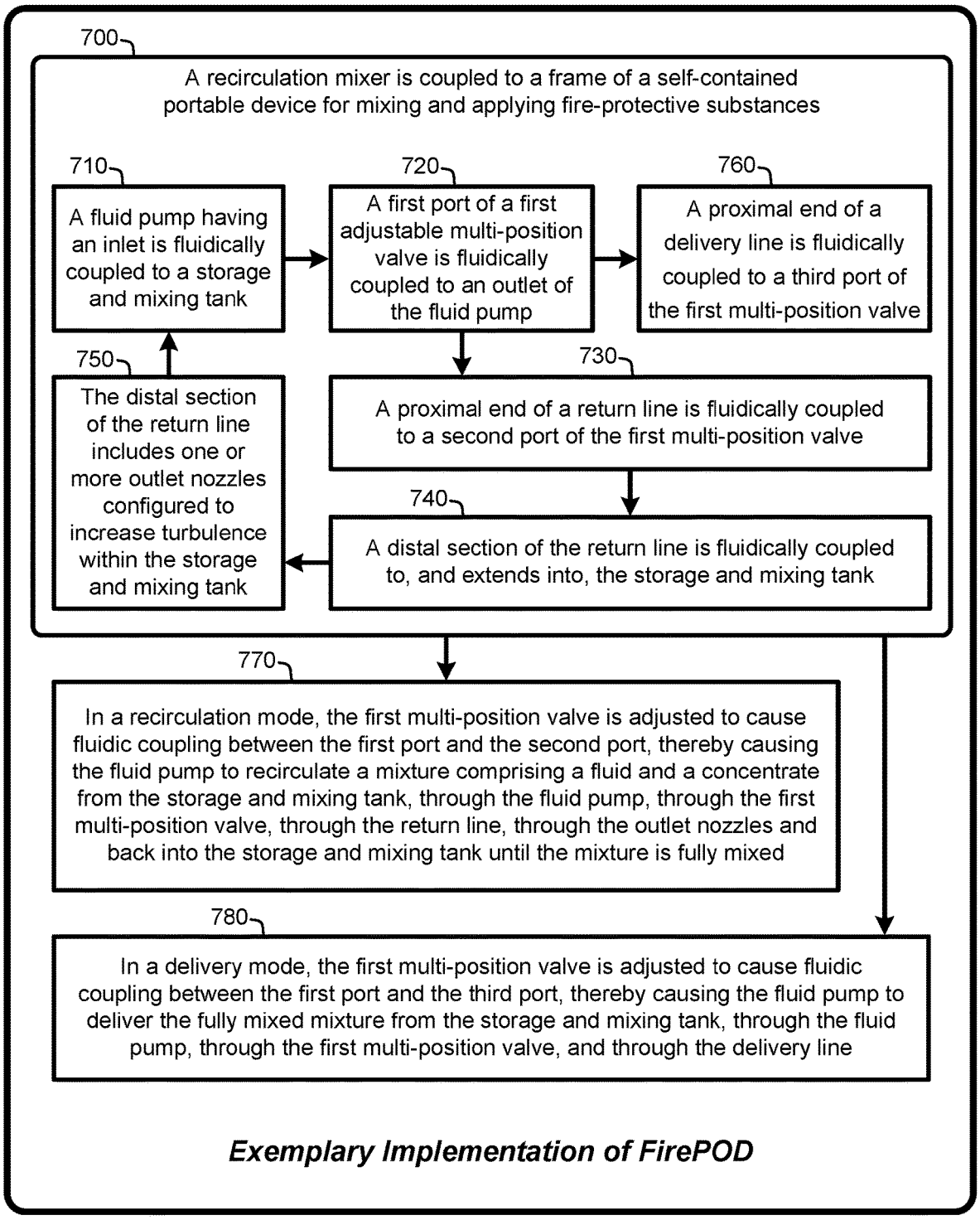
FIG. 7 illustrates a general system flow diagram that illustrates exemplary techniques for effecting various implementations of the FirePOD, as described herein.
Figure 8:
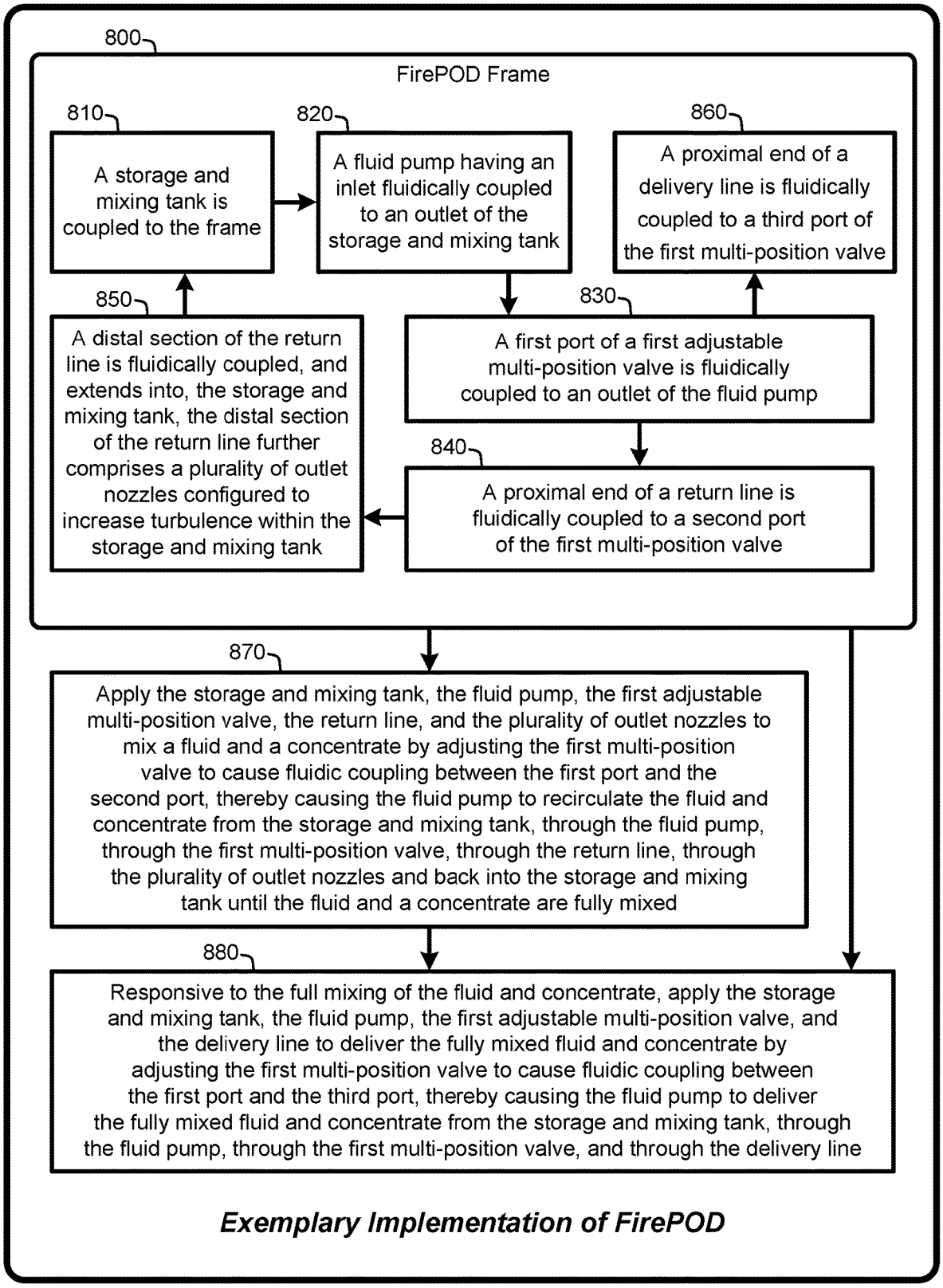
FIG. 8 illustrates a general system flow diagram that illustrates exemplary techniques for effecting various implementations of the FirePOD, as described herein.
Figure 9:
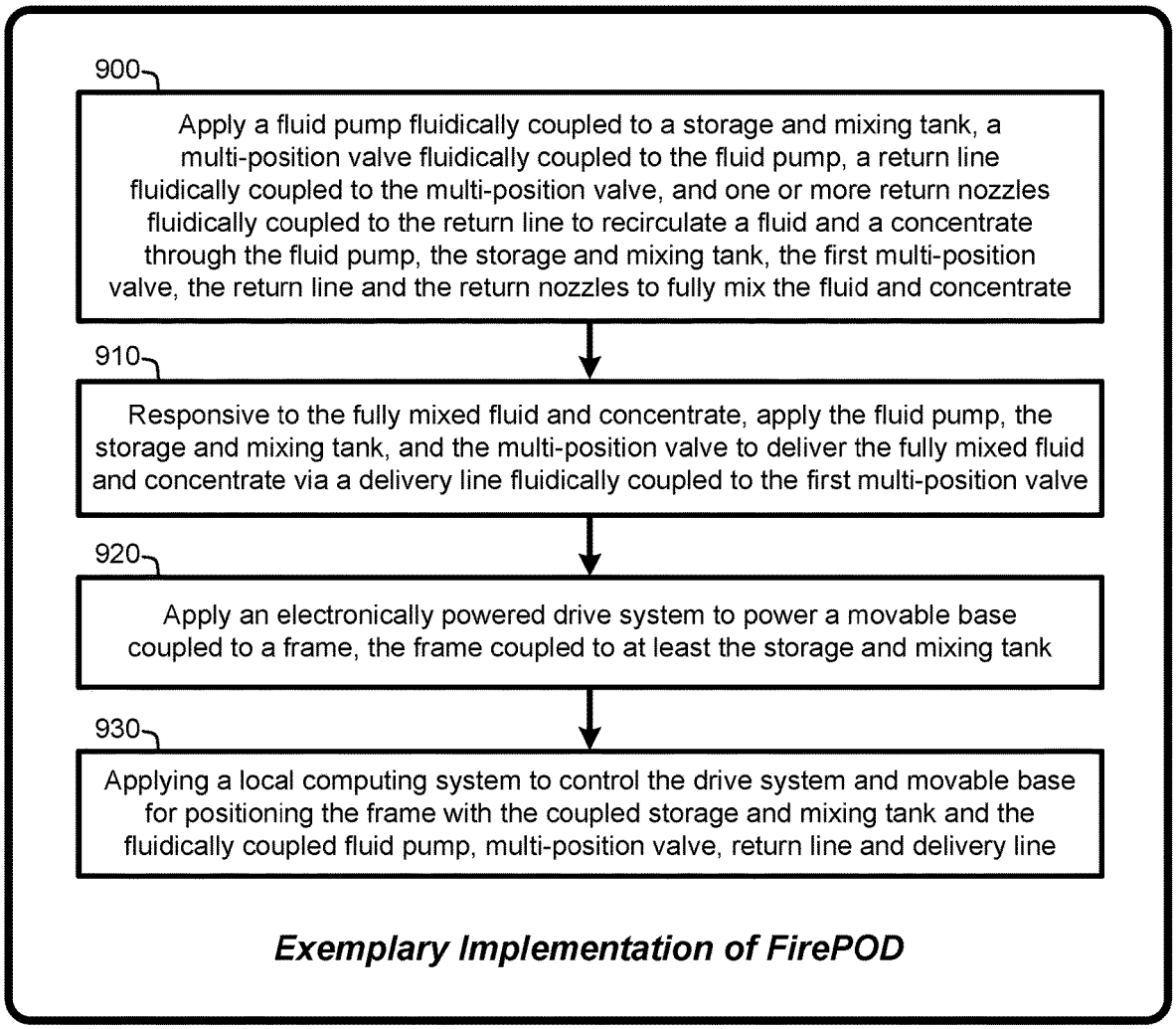
FIG. 9 illustrates a general system flow diagram that illustrates exemplary techniques for effecting various implementations of the FirePOD, as described herein.

The processes described above with respect to FIG. 1 through FIG. 6, and in further view of the detailed description provided above in Sections 1 and 2, are illustrated by the general operational flow diagrams of FIG. 7 through FIG. 9. In particular, FIG. 7 through FIG. 9 provide exemplary operational flow diagrams that summarize the operation of some of the various implementations of the FirePOD. Further, FIG. 7 through FIG. 9 are not intended to provide an exhaustive representation of all of the various implementations of the FirePOD described herein, and the implementations represented in these figures are provided only for purposes of explanation. In addition, any boxes and interconnections between boxes that may be represented by broken or dashed lines in FIG. 7 through FIG. 9 represent optional or alternate implementations of the FirePOD described herein, and any or all of these optional or alternate implementations, as described below, may be used in combination with other alternate implementations that are described throughout this document.

In general, as illustrated by FIG. 7, in various implementations, a recirculation mixer (700) of the FirePOD is coupled to a frame of a self-contained portable device for mixing and applying fire-protective substances. A fluid pump (710) having an inlet is fluidically coupled to a storage and mixing tank. In addition, a first port (720) of a first adjustable multi-position valve is fluidically coupled to an outlet of the fluid pump. Further, a proximal end (730) of a return line is fluidically coupled to a second port of the first multi-position valve. In this implementation, a distal section (740) of the return line is fluidically coupled to, and extends into, the storage and mixing tank. Further, the distal section of the return line includes (750) one or more outlet nozzles configured to increase turbulence within the storage and mixing tank. Additionally, a proximal end (760) of a delivery line is fluidically coupled to a third port of the first multi-position valve. In a recirculation mode (770) of the FirePOD, the first multi-position valve is adjusted to cause fluidic coupling between the first port and the second port, thereby causing the fluid pump to recirculate a mixture comprising a fluid and a concentrate from the storage and mixing tank, through the fluid pump, through the first multi-position valve, through the return line, through the outlet nozzles and back into the storage and mixing tank until the mixture is fully mixed. Finally, in a delivery mode (780) of the FirePOD, the first multi-position valve is adjusted to cause fluidic coupling between the first port and the third port, thereby causing the fluid pump to deliver the fully mixed mixture from the storage and mixing tank, through the fluid pump, through the first multi-position valve, and through the delivery line.

Similarly, as illustrated by FIG. 8, in various implementations, a frame (800) of the FirePOD includes a storage and mixing tank that is coupled (810) to the frame. This implementation of the FirePOD also includes a fluid pump (820) having an inlet fluidically coupled to an outlet of the storage and mixing tank. In addition, a first port (830) of a first adjustable multi-position valve is fluidically coupled to an outlet of the fluid pump. Further, a proximal end (840) of a return line is fluidically coupled to a second port of the first multi-position valve. In this implementation, a distal section (850) of the return line is fluidically coupled, and extends into, the storage and mixing tank, with the distal section of the return line further comprising a plurality of outlet nozzles configured to increase turbulence within the storage and mixing tank. Further, a proximal end (860) of a delivery line is fluidically coupled to a third port of the first multi-position valve. In this implementation, the FirePOD applies (870) the storage and mixing tank, the fluid pump, the first adjustable multi-position valve, the return line, and the plurality of outlet nozzles to mix a fluid and a concentrate by adjusting the first multi-position valve to cause fluidic coupling between the first port and the second port, thereby causing the fluid pump to recirculate the fluid and concentrate from the storage and mixing tank, through the fluid pump, through the first multi-position valve, through the return line, through the plurality of outlet nozzles and back into the storage and mixing tank until the fluid and a concentrate are fully mixed. Finally, responsive to the full mixing of the fluid and concentrate, The FirePOD applies (880) the storage and mixing tank, the fluid pump, the first adjustable multi-position valve, and the delivery line to deliver the fully mixed fluid and concentrate by adjusting the first multi-position valve to cause fluidic coupling between the first port and the third port, thereby causing the fluid pump to deliver the fully mixed fluid and concentrate from the storage and mixing tank, through the fluid pump, through the first multi-position valve, and through the delivery line.

Similarly, as illustrated by FIG. 9, in various implementations, the FirePOD begins operation by applying (900) a fluid pump fluidically coupled to a storage and mixing tank, a multi-position valve fluidically coupled to the fluid pump, a return line fluidically coupled to the multi-position valve, and one or more return nozzles fluidically coupled to the return line to recirculate a fluid and a concentrate through the fluid pump, the storage and mixing tank, the first multi-position valve, the return line and the return nozzles to fully mix the fluid and concentrate. Next, responsive to the fully mixed fluid and concentrate, the FirePOD applies (910) the fluid pump, the storage and mixing tank, and the multi-position valve to deliver the fully mixed fluid and concentrate via a delivery line fluidically coupled to the first multi-position valve. In addition, in this implementation, the FirePOD applies (920) an electronically powered drive system to power a movable base coupled to a frame, the frame coupled to at least the storage and mixing tank.

Finally, in this implementation, the FirePOD applies (930) a local computing system to control the drive system and movable base for positioning the frame with the coupled storage and mixing tank and the fluidically coupled fluid pump, multi-position valve, return line and delivery line.

4.0 Exemplary Operating Environments

Figure 10:
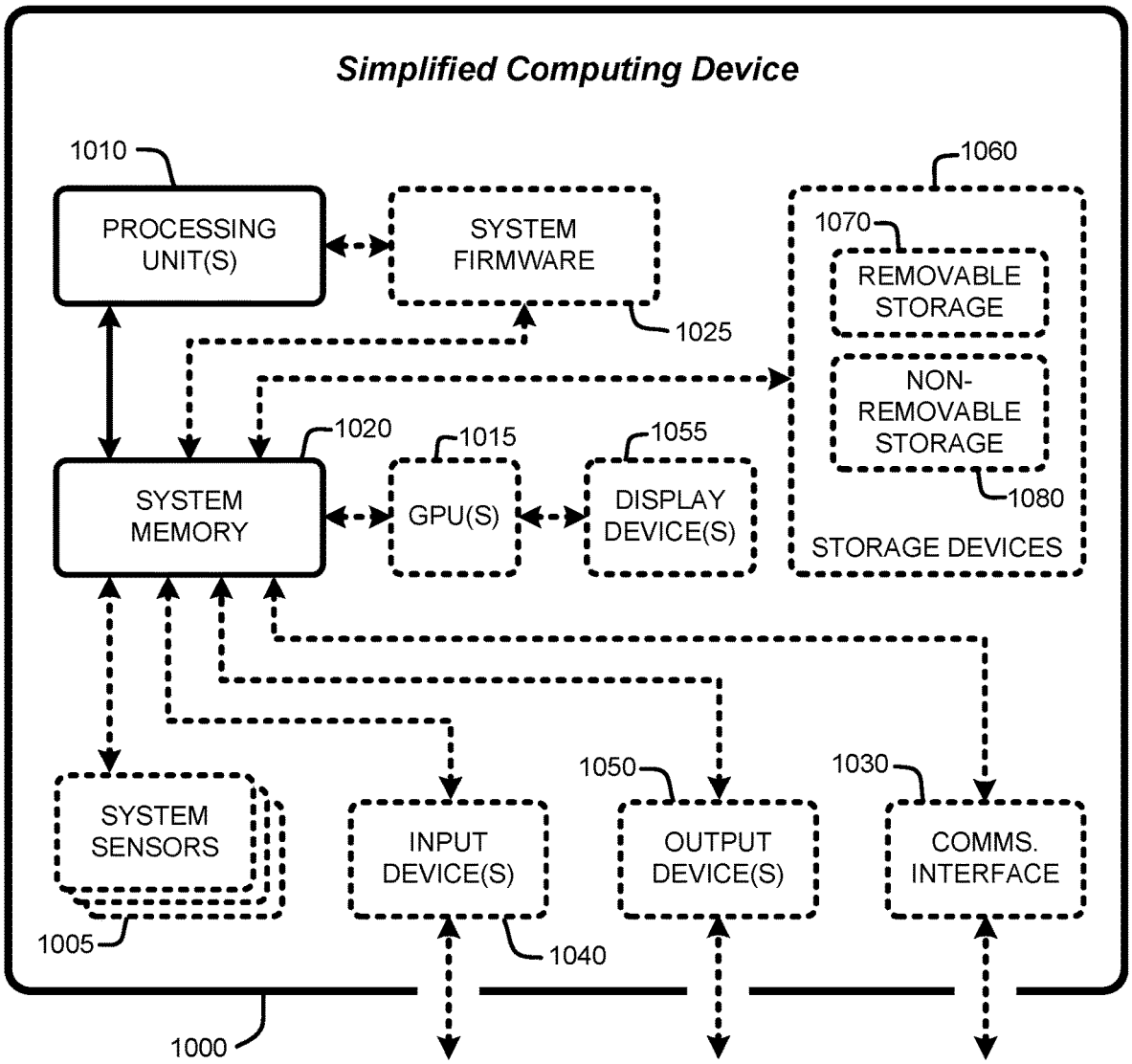
FIG. 10 is a general system diagram depicting a simplified general-purpose computing device having simplified computing and I/O capabilities for use in effecting various implementations of the FirePOD, as described herein.

The FirePOD implementations described herein are operational within numerous types of general purpose or special purpose computing system environments or configurations. For purposes of discussion, FIG. 10 illustrates a simplified example of a general-purpose computer system (e.g., local computing devices, local and remote servers, cloud-based computing systems, etc.) on which various implementations and elements of the FirePOD, as described herein, may be implemented. FIG. 10 is not intended to illustrate every component of a computer system as such components are well-known to those skilled in the art. Any boxes that are represented by broken or dashed lines in the simplified computing device 1000 shown in FIG. 10 represent alternate implementations of the simplified computing device. As described below, any or all of these alternate implementations may be used in combination with other alternate implementations that are described throughout this document.

The simplified computing device 1000 is typically found in devices having at least some minimum computational capability such as personal computers (PCs), server computers, handheld computing devices, laptop or mobile computers, communications devices such as cell phones and personal digital assistants (PDAs), multiprocessor systems, microprocessor-based systems, set top boxes, programmable consumer electronics, network PCs, minicomputers, mainframe computers, and audio or video media players.

To allow a device to realize the FirePOD implementations described herein, the device should have a sufficient computational capability and system memory to enable basic computational operations. In particular, the computational capability of the simplified computing device 1000 shown in FIG. 10 is generally illustrated by one or more processing unit(s) 1010, and may also include one or more graphics processing units (GPUs) 1015, either or both in communication with system memory 1020. The processing unit(s) 1010 of the simplified computing device 1000 may be specialized microprocessors (such as a digital signal processor (DSP), a very long instruction word (VLIW) processor, a field-programmable gate array (FPGA), or other micro-controller) or can be conventional central processing units (CPUs) having one or more processing cores and that may also include one or more GPU-based cores or other specific-purpose cores in a multi-core processor.

In addition, the simplified computing device 1000 may also include other components, such as, for example, a communications interface 1030. The simplified computing device 1000 may also include one or more conventional computer input devices 1040 (e.g., touchscreens, touch-sensitive surfaces, pointing devices, keyboards, audio input devices, voice or speech-based input and control devices, video input devices, haptic input devices, devices for receiving wired or wireless data transmissions, and the like) or any combination of such devices.

Similarly, various interactions with the simplified computing device 1000 and with any other component or feature of the FirePOD, including input, output, control, feedback, and response to one or more users or other devices or systems associated with the FirePOD, are enabled by a variety of Natural User Interface (NUI) scenarios. The NUI techniques and scenarios enabled by the FirePOD include, but are not limited to, interface technologies that allow one or more users user to interact with the FirePOD in a "natural" manner, free from artificial constraints imposed by input devices such as mice, keyboards, remote controls, and the like.

Such NUI implementations are enabled by the use of various techniques including, but not limited to, using NUI information derived from user speech or vocalizations captured via microphones or other input devices 1040 or system sensors 1005. Such NUI implementations are also enabled by the use of various techniques including, but not limited to, information derived from system sensors 1005 or other input devices 1040 from a user's facial expressions and from the positions, motions, or orientations of a user's hands, fingers, wrists, arms, legs, body, head, eyes, and the like, where such information may be captured using various types of 2D or depth imaging devices such as stereoscopic or time-of-flight camera systems, infrared camera systems, RGB (red, green and blue) camera systems, and the like, or any combination of such devices.

Further examples of such NUI implementations include, but are not limited to, NUI information derived from touch and stylus recognition, gesture recognition (both onscreen and adjacent to the screen or display surface), air or contact-based gestures, user touch (on various surfaces, objects or other users), hover-based inputs or actions, and the like. For example, a user may point to or otherwise designate a physical location desired for positioning the FirePOD. Automated or semi-automated mobility features of the FirePOD, as described in Section 2 of this document, may then automatically position the FirePOD at or near the designated position. Such NUI implementations may also include, but are not limited to, the use of various predictive machine intelligence processes that evaluate current or past user behaviors, inputs, actions, etc., either alone or in combination with other NUI information, to predict information such as user intentions, desires, and/or goals. Regardless of the type or source of the NUI-based information, such information may then be used to initiate, terminate, or otherwise control or interact with one or more inputs, outputs, actions, or functional features of the FirePOD.

However, the aforementioned exemplary NUI scenarios may be further augmented by combining the use of artificial constraints or additional signals with any combination of NUI inputs. Such artificial constraints or additional signals may be imposed or generated by input devices 1040 such as mice, keyboards, and remote controls, or by a variety of remote or user worn devices such as accelerometers, electromyography (EMG) sensors for receiving myoelectric signals representative of electrical signals generated by user's muscles, heart-rate monitors, galvanic skin conduction sensors for measuring user perspiration, wearable or remote biosensors for measuring or otherwise sensing user brain activity or electric fields, wearable or remote biosensors for measuring user body temperature changes or differentials, and the like. Any such information derived from these types of artificial constraints or additional signals may be combined with any one or more NUI inputs to initiate, terminate, or otherwise control or interact with one or more inputs, outputs, actions, or functional features of the FirePOD.

The simplified computing device 1000 may also include other optional components such as one or more conventional computer output devices 1050 (e.g., display device(s) 1055, audio output devices, video output devices, devices for transmitting wired or wireless data transmissions, and the like). Typical communications interfaces 1030, input devices 1040, output devices 1050, and storage devices 1060 for general-purpose computers are well known to those skilled in the art, and will not be described in detail herein.

The simplified computing device 1000 shown in FIG. 10 may also include a variety of computer-readable media. Computer-readable media can be any available media that can be accessed by the computing device 1000 via storage devices 1060, and include both volatile and nonvolatile media that is either removable 1070 and/or non-removable 1080, for storage of information such as computer-readable or computer-executable instructions, data structures, programs, subprograms, program modules, or other data.

Computer-readable media includes computer storage media and communication media. Computer storage media refers to tangible computer-readable or machine-readable media or storage devices such as digital versatile disks (DVDs), Blu-ray discs (BD), compact discs (CDs), floppy disks, tape drives, hard drives, optical drives, solid state memory devices, random access memory (RAM), read-only memory (ROM), electrically erasable programmable read-only memory (EEPROM), CD-ROM or other optical disk storage, smart cards, flash memory (e.g., card, stick, and key drive), magnetic cassettes, magnetic tapes, magnetic disk storage, magnetic strips, or other magnetic storage devices. Further, a propagated signal is not included within the scope of computer-readable storage media.

Retention of information such as computer-readable or computer-executable instructions, data structures, programs, subprograms, program modules, and the like, can also be accomplished by using any of a variety of the aforementioned communication media (as opposed to computer storage media) to encode one or more modulated data signals or carrier waves, or other transport mechanisms or communications protocols, and can include any wired or wireless information delivery mechanism. The terms "modulated data signal" or "carrier wave" generally refer to a signal that has one or more of its characteristics set or changed in such a manner as to encode information in the signal. For example, communication media can include wired media such as a wired network or direct-wired connection carrying one or more modulated data signals, and wireless media such as acoustic, radio frequency (RF), infrared, laser, and other wireless media for transmitting and/or receiving one or more modulated data signals or carrier waves.

Furthermore, software, programs, and/or computer program products embodying some or all of the various FirePOD implementations described herein, or portions thereof, may be stored, received, transmitted, or read from any desired combination of computer-readable or machine-readable media or storage devices and communication media in the form of computer-executable instructions or other data structures. Additionally, the claimed subject matter may be implemented as a method, apparatus, or article of manufacture using standard programming and/or engineering techniques to produce software, firmware 1025, hardware, or any combination thereof to control a computer to implement the disclosed subject matter. The term "article of manufacture" as used herein is intended to encompass a computer program accessible from any computer-readable device, or media.

The FirePOD implementations described herein may be further described in the general context of computer-executable instructions, such as a program and subprograms, being executed by a computing device. Generally, programs and subprograms include routines, programs, objects, components, data structures, and the like, that perform particular tasks or implement particular abstract data types. The FirePOD implementations may also be practiced in distributed computing environments where tasks are performed by one or more remote processing devices, or within a cloud of one or more devices, that are linked through one or more communications networks. In a distributed computing environment, programs and subprograms may be located in both local and remote computer storage media including media storage devices. Additionally, the aforementioned instructions may be implemented, in part or in whole, as hardware logic circuits, which may or may not include a processor.

Alternatively, or in addition, the functionality described herein can be performed, at least in part, by one or more hardware logic components. For example, and without limitation, illustrative types of hardware logic components that can be used include field-programmable gate arrays (FPGAs), application-specific integrated circuits (ASICs), application-specific standard products (ASSPs), system-on-a-chip systems (SOCs), complex programmable logic devices (CPLDs), and so on.

5.0 Other Implementations

The foregoing description of the FirePOD has been presented for the purposes of illustration and description. It is not intended to be exhaustive or to limit the claimed subject matter to the precise form disclosed. Many modifications and variations are possible in light of the above teaching. Further, any or all of the aforementioned alternate implementations may be used in any combination desired to form additional hybrid implementations of the FirePOD. It is intended that the scope of the FirePOD be limited not by this detailed description, but rather by the claims appended hereto. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims and other equivalent features and acts are intended to be within the scope of the claims.

What has been described above includes example implementations. It is, of course, not possible to describe every conceivable combination of components or methodologies for purposes of describing the claimed subject matter, but one of ordinary skill in the art may recognize that many further combinations and permutations are possible. Accordingly, the claimed subject matter is intended to embrace all such alterations, modifications, and variations that fall within the spirit and scope of detailed description of the FirePOD described above.

In regard to the various functions performed by the above described components, devices, circuits, systems and the like, the terms (including a reference to a "means") used to describe such components are intended to correspond, unless otherwise indicated, to any component which performs the specified function of the described component (e.g., a functional equivalent), even though not structurally equivalent to the disclosed structure, which performs the function in the herein illustrated exemplary aspects of the claimed subject matter. In this regard, it will also be recognized that the foregoing implementations include a system as well as a computer-readable storage media having computer-executable instructions for performing the acts and/or events of the various methods of the claimed subject matter.

There are multiple ways of realizing the foregoing implementations (such as an appropriate application programming interface (API), tool kit, driver code, operating system, control, standalone or downloadable software object, or the like), which enable applications and services to use the implementations described herein. The claimed subject matter contemplates this use from the standpoint of an API (or other software object), as well as from the standpoint of a software or hardware object that operates according to the implementations set forth herein. Thus, various implementations described herein may have aspects that are wholly in hardware, or partly in hardware and partly in software, or wholly in software.

The aforementioned systems have been described with respect to interaction between several components. It will be appreciated that such systems and components can include those components or specified sub-components, some of the specified components or sub-components, and/or additional components, and according to various permutations and combinations of the foregoing. Sub-components can also be implemented as components communicatively coupled to other components rather than included within parent components (e.g., hierarchical components).

Additionally, one or more components may be combined into a single component providing aggregate functionality or divided into several separate sub-components, and any one or more middle layers, such as a management layer, may be provided to communicatively couple to such sub-components in order to provide integrated functionality. Any components described herein may also interact with one or more other components not specifically described herein but generally known to enable such interactions.

What is claimed is:

1. A self-contained portable device for mixing and applying fire-protective substances, comprising:

a recirculation mixer coupled to a frame of the self-contained portable device, the recirculation mixer comprising:

a fluid pump having an inlet fluidically coupled to a storage and mixing tank, a first port of a first adjustable multi-position valve fluidically coupled to an outlet of the fluid pump, a proximal end of a return line fluidically coupled to a second port of the first multi-position valve, a distal section of the return line fluidically coupled, and extending into, the storage and mixing tank, and the distal section of the return line further comprising one more outlet nozzles configured to increase turbulence within the storage and mixing tank;

a proximal end of a delivery line fluidically coupled to a third port of the first multi-position valve;

in a recirculation mode, the first multi-position valve adjusted to cause fluidic coupling between the first port and the second port, thereby causing the fluid pump to recirculate a mixture comprising a fluid and a concentrate from the storage and mixing tank, through the fluid pump, through the first multi-position valve, through the return line, through the one or more outlet nozzles and back into the storage and mixing tank until the mixture is fully mixed; and in a delivery mode, the first multi-position valve adjusted to cause fluidic coupling between the first port and the third port, thereby causing the fluid pump to deliver the fully mixed mixture from the storage and mixing tank, through the fluid pump, through the first multi-position valve, and through the delivery line.

2. The self-contained portable device of claim 1 further comprising:

second adjustable multi-position valve having an input port fluidically coupled to a distal end of the delivery line;

the second multi-position valve having two or more output ports, each output port fluidically coupled to a separate delivery hose; and the second multi-position valve adjusted to enable concurrent fluidic coupling between the input port and one or more of the output ports.

3. The self-contained portable device of claim 1 further comprising a delivery nozzle fluidically coupled to a distal end of the delivery line.

4. The self-contained portable device of claim 1 further comprising a movable base removably attached to the frame to enable movement of the self-contained portable device.

5. The self-contained portable device of claim 4, the movable base further comprising, one or more of:

a wheeled base;

a tracked base;

a skid base;

a pallet base; and a floating base.

6. The self-contained portable device of claim 4, the movable base further comprising a drive system mechanically coupled to the movable base to cause powered movement of the movable base and the removably attached self-contained portable device.

7. The self-contained portable device of claim 6 further comprising a local computing device in communication with the drive system, the local computing device adapted to automatically control the powered movement of the movable base and the removably attached self-contained portable device.

8. The self-contained portable device of claim 7 further comprising a remote computing device in communication with the local computing device, the remote computing device adapted to automatically control the local computing device.

9. The self-contained portable device of claim 1 comprising one or more electrical power sources mechanically coupled to the frame.

10. The self-contained portable device of claim 9 further comprising a plurality of electrical switches electrically coupled between the recirculation mixer and one or more of the power sources to regulate electrical power supplied by the one or more power sources to any of the fluid pump and the first adjustable multi-position valve of the recirculation mixer.

11. The self-contained portable device of claim 10 further comprising a local computing device in communication with and automatically controlling one or more of the plurality of electrical switches to regulate the electrical power supplied by the one or more power sources to any of the fluid pump and the first adjustable multi-position valve of the recirculation mixer.

12. The self-contained portable device of claim 1, wherein the one or more outlet nozzles of the distal section of the return line are further configured to direct a portion of the flow from the one or more of the return nozzles towards a tank outflow port or drain to prevent a buildup of concentrate at or near the outflow port or drain thereby reducing a possibility of clogging.

13. The self-contained portable device, of claim 1, wherein the one or more outlet nozzles of the distal section of the return line further prevent or disrupt laminar flow within the storage tank, thereby reducing mixing time.

14. A system, comprising:

a frame;

a storage and mixing tank coupled to the frame;

a fluid pump having an inlet fluidically coupled to an outlet of the storage and mixing tank;

a first port of a first adjustable multi-position valve fluidically coupled to an outlet of the fluid pump, a proximal end of a return line fluidically coupled to a second port of the first multi-position valve, a distal section of the return line fluidically coupled, and extending into, the storage and mixing tank, the distal section of the return line further comprising a plurality of outlet nozzles configured to increase turbulence within the storage and mixing tank;

a proximal end of of a delivery line fluidically coupled to a third port of the first multi-position valve;

applying the storage and mixing tank, the fluid pump, the first adjustable multi-position valve, the return line, and the plurality of outlet nozzles to mix a fluid and a concentrate by adjusting the first multi-position valve to cause fluidic coupling between the first port and the second port, thereby causing the fluid pump to recirculate the fluid and concentrate from the storage and mixing tank, through the fluid pump, through the first multi-position valve, through the return line, through the plurality of outlet nozzles and back into the storage and mixing tank until the fluid and a concentrate are fully mixed; and responsive to the full mixing of the fluid and concentrate, applying the storage and mixing tank, the fluid pump, the first adjustable multi-position valve, and the delivery line to deliver the fully mixed fluid and concentrate by adjusting the first multi-position valve to cause fluidic coupling between the first port and the third port, thereby causing the fluid pump to deliver the fully mixed fluid and concentrate from the storage and mixing tank, through the fluid pump, through the first multi-position valve, and through the delivery line.

15. The system of claim 14 further comprising:

a second adjustable multi-position valve having an input port fluidically coupled to a distal end of the delivery line;

the second multi-position valve having two or more output port each output port fluidically coupled to a separate delivery hose; and adjusting the second multi-position valve to enable concurrent fluidic coupling between the input port and two or more of the output ports of the second multi-position valve.

16. The system of claim 15 further comprising a movable base removably coupled to the frame.

17. The system of claim 16 further comprising:

one or more electrical power sources mechanically coupled to any of the movable base and the frame;

a drive system mechanically coupled to the movable base and electrically coupled to one or more of the electrical power sources to cause powered movement of the movable base and the frame; and a local computing device in communication with the drive system, the local computing device adapted to automatically control the powered movement of the movable base and the frame.

18. The system of claim 17 further comprising a remote computing device in communication with the local computing device, the remote computing device adapted to automatically control the powered movement of the movable base and the frame via the communication with the local computing device.

19. The system of claim 17 further comprising:

a first electrical switch electrically coupled between the fluid pump and one or more of the electrical power sources;

a second electrical switch electrically coupled between the first adjustable multi-position valve and one or more of the electrical power sources;

the first electrical switch in communication with and controlled by the local computing device to regulate electrical power supplied by the one or more power sources to the fluid pump; and the second electrical switch in communication with and controlled by the local computing device to regulate electrical power supplied by the one more power sources to configure the first adjustable multi-position valve to control the fluidic coupling between the different ports of the first adjustable multi-position valve.

20. The system of claim 14, wherein the plurality of outlet nozzles of the distal section of the return line are further configured to direct a portion of the flow from the one or more of the return nozzles towards a tank outflow port or drain to prevent a buildup of concentrate at or near the outflow port or drain, thereby reducing a possibility of clogging.

* * * * *